US005726666A

United States Patent [19]

Hoover et al.

[11] Patent Number: 5,726,666

[45] Date of Patent: Mar. 10, 1998

[54] OMNIDIRECTIONAL ANTENNA WITH SINGLE FEEDPOINT

[75] Inventors: John C. Hoover, Roswell; David J. Kiesling, Atlanta, both of Ga.

[73] Assignee: EMS Technologies, Inc., Norcross, Ga.

[21] Appl. No.: 626,475

[22] Filed: Apr. 2, 1996

[51] Int. Cl.[6] ..... H01Q 13/10

[52] U.S. Cl. ..... 343/770; 343/767

[58] Field of Search ..... 343/770, 771, 343/767, 772, 786, 768; H01Q 13/10

[56] References Cited

U.S. PATENT DOCUMENTS

| | | | |
|---|---|---|---|
| 3,218,644 | 11/1965 | Berry | 343/770 |
| 4,245,222 | 1/1981 | Eng et al. | 343/770 |
| 4,916,458 | 4/1990 | Goto | 343/770 |
| 5,289,200 | 2/1994 | Kelly | 343/771 |

OTHER PUBLICATIONS

"Antenna Handbook—Theory, Applications, and Design", by Y.T. Lo and S.W. Lee, published by Van Nostrand Reinhold Company, New York, New York, copyright 1988, pp. 17–32–17–35, no month.

*Primary Examiner*—Hoanganh T. Le

*Attorney, Agent, or Firm*—Jones & Askew, LLP

[57] ABSTRACT

An antenna comprising a waveguide component and a probe assembly, coupled to the antenna assembly, for distributing radio frequency (RF) energy to slots positioned on at least one of the broad walls of the waveguide component. The probe assembly can be positioned at the approximate center point of the waveguide component to present a desired impedance to the waveguide cavity and to distribute RF energy of substantially equal amplitude and phase to each section of the waveguide cavity. The probe assembly includes a post, connected to one or both of the rear and front walls, and a probe pin. The post, which is typically positioned within the center of the waveguide cavity, comprises (1) a post cavity located within and extending along at least a portion of the post, and (2) a post slot having an opening located along the post and traversing the post cavity. A probe pin, which is inserted within one end of the post cavity and connected to the opposite end of the post cavity, couples the RF energy to the waveguide cavity via the post slot.

21 Claims, 15 Drawing Sheets

OMNIDIRECTIONAL ANTENNA WITH SINGLE FEEDPOINT

FIELD OF THE INVENTION

This invention is generally directed to a feed distribution system for an omnidirectional antenna and, more particularly described, is a single feedpoint for a waveguide-implemented antenna having a collinear array of slots and exhibiting an omnidirectional radiation pattern.

BACKGROUND OF THE INVENTION

A common feature of the architecture of a number of systems for wireless radio frequency communications, including wireless local loop (WLL) services, cellular mobile radiotelephone (CMR) services, and personal communications services (PCS), is the provision of a communications link between a plurality of fixed sites. For CMR, PCS, and other systems designed to provide communications capability to mobile subscribers, communications links are used between cell sites and for connection to the public switched telephone network (PSTN). For WLL systems in rural and/or developing areas, communications links may be required between cell sites and to fixed subscribers, as well as for cell-to-cell and PSTN connections.

To provide communication links between a central fixed site and multiple remote sites, an omnidirectional ("omni") radio frequency (RF) antenna is typically used at the central site. An omni antenna typically consists of stacked radiating elements in the vertical direction. The total number of radiating elements is typically determined by the number of wavelengths required to achieve the desired gain. The elements can be dipoles, slots, or patches arranged to give an omnidirectional radiation pattern in the horizontal plane. A feed system is part of the omni antenna and provides a portion of the RF signal at the correct phase to each radiating element.

The feed system typically can be implemented by a corporate feed using couplers and transmission lines, waveguide, coax, strip transmission line, or microstrip transmission line, with the path lengths being the same for each element. The feed system also can be a series feed, wherein each element taps off a common transmission line at the point that the phasing is correct. The power level, frequency range, bandwidth and cost considerations are important in determining the type of feed system for an omni antenna.

For conventional "wired" telecommunications systems, the cost per line in sparsely-populated areas may be five to ten times the cost per line in urban areas. Wireless local loop (WLL) systems offer a more cost-effective alternative to such conventional wired systems in many areas of the world. While CMR systems were originally deployed in urban areas and have been marketed as a premium service in those areas, the technology developed for cellular communications is now being deployed within WLL systems in many developing nations where a fixed-wire telecommunications infrastructure is limited or inadequate. Because of the large service area that can be covered by CMR technology, capital costs for deployment of WLL systems are generally substantially lower than for fixed-wire networks providing ubiquitous coverage to an equivalent area. WLL systems typically complement a limited fixed-wire system, but in some situations WLL systems may be more economical to deploy as a complete alternative telecommunications system.

To enable the deployment of WLL and other wireless communications systems in remote and/or developing areas of the world, a need exists for a low-cost, environmentally-robust omnidirectional antenna providing at least moderate antenna gain for fixed-site communications, particularly within the frequency spectrum near 900 MHz and 1800 MHz and at higher frequencies.

Patch-type flat plate antennas, which are typically implemented by etching a dielectric substrate, can be used to provide a low profile antenna for this fixed site antenna application. However, patch-type antennas are generally not viewed as an economical solution because the material cost and etching process are relatively expensive and the radiating patch elements require environmental protection. Moreover, if a large number of patch elements are required to obtain desired antenna gain, the feed network becomes complex and lossy. This loss is undesirable because it directly subtracts from the antenna gain.

Slotted array antennas, which can provide a low profile solution to the fixed site antenna requirements for a cellular communications application, have typically been used for aircraft radar applications and in electronic warfare environments. For the typical high power radar system, the slotted array antenna uses a waveguide distribution network for distributing the RF energy to and from slot elements. The waveguide is a low loss solution for the feed network, but this leads to a relatively complex waveguide design, including T-elements and hybrid components, which can be expensive to produce and assemble. In contrast, the feed distribution network for slotted array antennas in low power applications traditionally have been implemented by microstrip designs. However, a microstrip design requires etching of a dielectric substrate and electrical contact soldering, which lead to relatively high production costs. Also, a microstrip design of a feed distribution network has a relatively high loss and requires protection from the environment. Both the waveguide and microstrip-implemented feed distribution networks typically include multiple transitions, which can contribute to signal loss for the communications system. Although the slotted array antenna exhibits the desirable characteristic of a low-profile antenna, there is a need for a simple and economical distribution network or launch point for feeding the slotted array.

To achieve an omnidirectional radiation pattern for a waveguide-implemented slotted array antenna, the slots are typically spaced one-half wavelength apart and are offset by equal and opposite amounts from a center line to obtain excitation in equal phase. In addition, wide extensions or wings are typically added along the narrow side walls of the waveguide component to reduce ripple or directivity in the azimuth plane and thereby obtain a more true omnidirectional radiation pattern. Unfortunately, the addition of extensions along the waveguide side walls increases the profile of the antenna and leads to the disadvantage of substantial wind loading. Thus, there exists a need for a low profile antenna, such as a slotted array antenna, having a reduced ripple characteristic in the antenna pattern to achieve true omnidirectional coverage without the use of wings or extensions.

In summary, there exists a need for a low profile antenna having a simple feed distribution network and exhibiting the characteristics of low-cost, moderate antenna gain, and environmental robustness. The present invention overcomes the disadvantages of prior art antenna designs by providing (1) a slotted array antenna characterized by a simplified feed that replaces the power divider structures utilized in prior art antennas and a reduced height waveguide implementation to achieve a relatively high aspect ratio, and (2) an approach to the manufacture of a slotted array antenna that relies upon simple, cost-effective sheet metal manufacturing processes.

Specifically, the present invention provides a low profile, omnidirectional antenna based on a waveguide-implemented slotted array design employing a single probe element to provide moderate antenna gain in an environmentally-robust configuration that is realizable at low cost.

SUMMARY OF THE INVENTION

The present invention provides significant advantages over the prior art by providing a distribution network having a single probe element to distribute radio frequency (RF) energy to and from a waveguide-implemented antenna having a planar array of slot elements. In general, the present invention is directed to a slotted antenna having an antenna assembly comprising a waveguide component and a probe assembly, coupled to the antenna assembly, for distributing radio frequency (RF) energy to slots positioned on at least one of the broad walls of the waveguide component. A reentrant-type probe can be mounted at the approximate center point of the antenna assembly to distribute RF energy of substantially equal amplitude and phase within the waveguide cavity and to the slots. To achieve an omnidirectional radiation pattern while maintaining a low profile design, the slotted antenna can be constructed from reduced height waveguide.

The antenna assembly has a waveguide cavity formed by a plurality of intersecting wall segments. The wall segments include a rear wall, a front wall, and a pair of side walls. The rear wall and the front wall are positioned in spaced-apart parallel planes, and connected by a pair of spaced-apart side walls. End caps are connected to each end of the waveguide cavity and operate as short circuits to terminate both ends of the waveguide cavity. The minimum dimension of the rear wall and the front wall is typically greater than the corresponding minimum dimension of each side. Thus, the height of the waveguide cavity is much less than its width. Specifically, the aspect ratio of the antenna, which is defined by a ratio of a minor dimension of the front wall (or the rear wall) to a minor dimension of one of the side walls, can be relatively large, typically 8:1.

To obtain an omnidirectional radiation pattern, each of the front and rear walls have a planar array of slots positioned along the major axis of the antenna. On the other hand, a directional antenna pattern can be obtained by placing the array of slots along only one of the broad walls of the waveguide component. For each radiation pattern, adjacent slots are typically spaced one-half waveguide apart and offset to accomplish a phase reversal from a center line extending the major axis of the antenna assembly. The amount of offset determines the amount of coupling at that slot.

The probe assembly can be positioned at the approximate center point of the antenna body. It presents a desired impedance to the waveguide cavity and distributes RF energy of substantially equal amplitude and phase to each section of the waveguide cavity. The probe assembly includes a post, connected to one or both of the rear and front walls, and a probe pin. The post, which is typically positioned within the center of the waveguide cavity, comprises (1) a post cavity located within and extending along at least a portion of the post, and (2) a post slot having an opening located along the post and traversing the post cavity. The post slot typically is a radial gap that extends along opposite sides of the post. A probe pin, which is inserted within one end of the post cavity and connected to the opposite end of the post cavity, couples the RF energy to the waveguide cavity via the post slot. It will be appreciated that a reentrant-type probe design can be obtained by extending the post between the rear and front walls and inserting the probe pin within the post cavity to allow RF energy to be distributed via the post slot.

The post slot can be positioned at a mid-point of the post and centrally placed within the waveguide cavity and between the front wall and the rear wall. For example, the post slot is typically centered between the front and rear broad walls of the waveguide to support equal distribution of RF energy to radiating slots on both broad walls to achieve omnidirectional antenna coverage. Alternatively, the post slot can be located between one end of the post and adjacent to either the rear wall or the front wall. For this alternative configuration, the post can be connected to either the front wall or the rear wall, and the post slot placed opposite to the selected wall and adjacent to the nonselected wall. This alternative configuration for the post slot can be used to support the distribution of RF energy to the slots on a single broad wall to support a directional radiation pattern.

The probe assembly can also include a dielectric spacing element for adjusting the impedance presented by the probe to the waveguide cavity. The dielectric spacing element is located within the opening of the post slot and adjacent to the probe pin. It comprises a dielectric material, such as "ULTEM" or "TEFLON", and has a clearance hole for allowing passage of the probe pin through the element. The dielectric spacing element is typically constructed as a ring or bead of dielectric material and can be bonded to the edges of the post slot.

Another dielectric element, typically used as a tuning element, can also be used to adjust the impedance presented by the probe to the waveguide cavity. The dielectric tuning element can be positioned at the opening of the post cavity and adjacent to either the front wall or the rear wall. The dielectric tuning elements comprise a dielectric material, typically "TEFLON", and has a clearance hole for allowing passage of the probe pin through this element. The dielectric tuning element is typically constructed as a ring or bead of dielectric material. The impedance characteristic exhibited by the dielectric tuning element can be varied by changing physical dimensions or the dielectric constant.

A high impedance coaxial section is created by inserting the probe pin within the post cavity of the probe assembly. Because the probe pin typically has a diameter that is less than the diameter of the post cavity, an air gap is created between the probe pin and the post cavity. This combination of dielectric material, i.e., the air gap, and the probe pin, can be modeled as a series inductance for the impedance presented by the probe to the waveguide cavity. Similarly, the dielectric spacing and tuning elements can be modeled as shunt capacitances for the probe impedance.

For a probe assembly comprising a post, a probe pin, a dielectric spacing element, and a dielectric tuning element, the equivalent "LC" circuit for this probe design can include distributed elements of a series inductor connected between shunt capacitors. The shunt capacitance values are defined by the impedances for the dielectric spacing and tuning elements.

The probe assembly can further include an antenna connector, mounted to either the rear wall or the front wall, to transport the RF energy to and from a source, such as a receiver or transmitter, to the probe assembly. The antenna connector, typically a TNC-type connector for many wireless communications applications, includes a center conductor that extends into the post cavity via a mounting opening on antenna assembly. The center conductor is typically connected to the probe pin and can be viewed as a portion of the probe pin. The probe pin comprises a conductive element positioned between the center conductor and the broad wall opposite the probe assembly.

Turning now to another aspect of the present invention, the post of the probe assembly can include a pair of shells, each shell connected to one of the broad walls of the waveguide component and to a dielectric spacing element. The first shell is connected to the rear wall and extends into the waveguide cavity. This first shell has a first shell cavity located within and extending along a portion of at least a portion of the first shell. Likewise, the second shell, which is connected to the front wall and extends into the waveguide cavity, has a second shell cavity extending along at least a portion of the second shell. Although the first shell is aligned in position with the second shell, the shells are not connected to each other. Instead, a radial gap or opening between the pair of shells forms a post slot, which can be filled by the dielectric spacing element. In particular, the dielectric spacing element can be bonded to the shell ends that are not connected to the broad walls of the waveguide component. The probe pin is inserted within the first shell cavity and the second shell cavity to couple RF energy to the waveguide cavity. Thus, the dielectric spacing element includes a first clearance hole for allowing passage of the probe pin through the dielectric spacing element. The antenna connector can be connected to the rear wall and includes a center conductor extending into the first shell cavity connected to the probe pin. Although the dielectric spacing element can be used to vary the impedance presented by the probe assembly, another dielectric element, namely a dielectric tuning element, can be positioned within the first shell cavity and adjacent to the rear wall to achieve additional impedance match flexibility.

In view of the foregoing, it is an object of the present invention to provide a low-cost, environmentally-robust antenna providing at least moderate gain and an omnidirectional radiation pattern for fixed-site cellular communications.

It is a further object of the present invention to provide a simple, efficient, and economical distribution network for an omnidirectional, planar array antenna having slot elements.

It is a further object of the present invention to provide a distribution network having a single feed point for a waveguide-implemented planar array antenna having longitudinal slots along both broad waveguide walls.

It is a further object of the present invention to provide a probe for distributing RF energy in equal phase and amplitude to a waveguide-implemented planar array antenna having longitudinal slots along both front and rear walls of the waveguide cavity.

It is a further object of the present invention to provide a reduced height, waveguide-implemented slotted array antenna having a substantially true omnidirectional pattern.

It is a further object of the present invention to provide an economical and efficient process for manufacturing a slotted array antenna of the present invention.

These and other advantages of the present invention will become apparent from the detailed description and drawings to follow and the appended claim set.

DETAILED DESCRIPTION OF EMBODIMENTS OF THE PRESENT INVENTION

Figure 1:
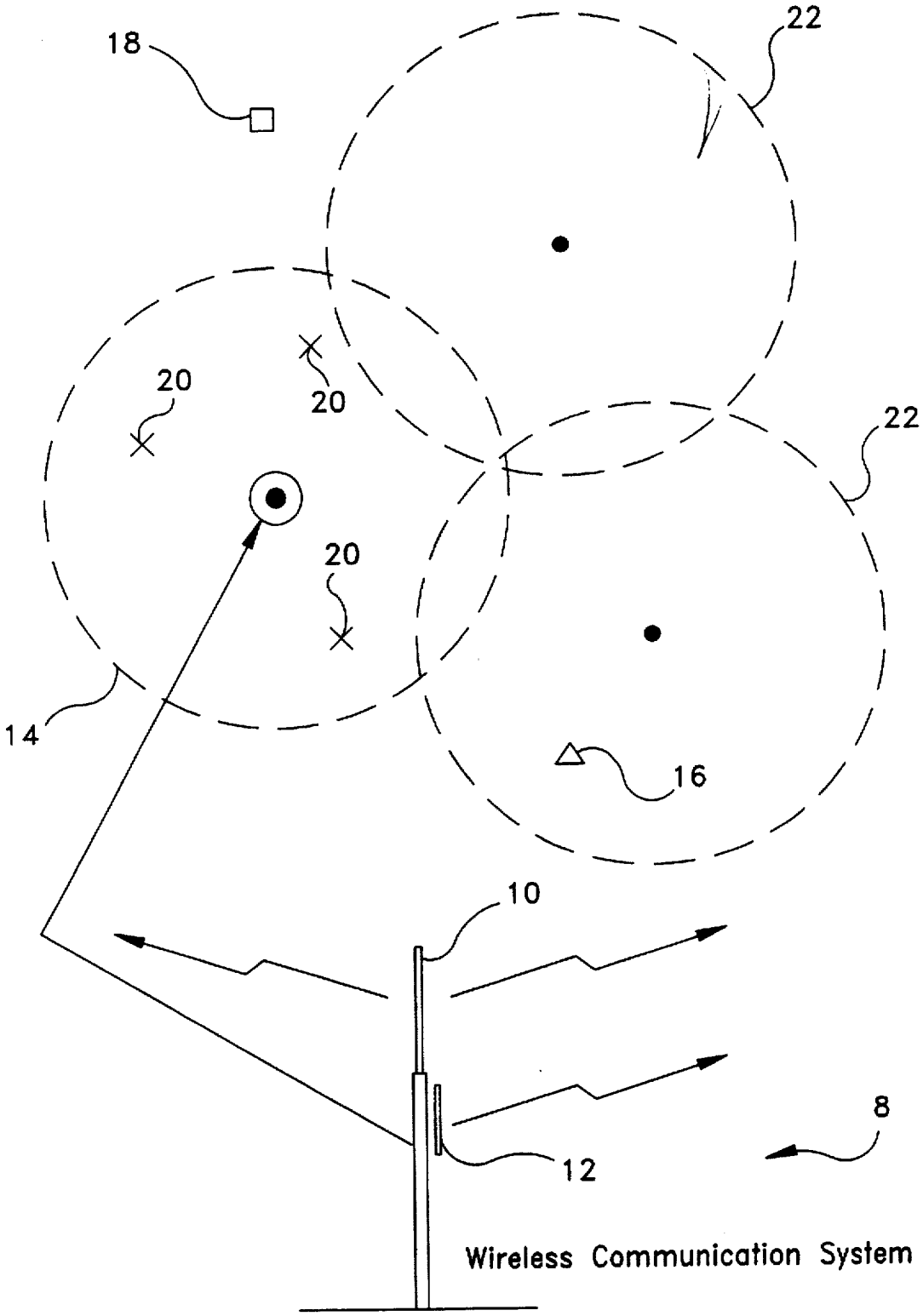
FIG. 1 is a block diagram showing the operating environment of a wireless radio frequency communications system employing the preferred embodiment of the present invention.

The antenna of the present invention is primarily useful as a fixed-site antenna for transmitting and/or receiving radio frequency (RF) signals in a cost-effective manner for a wide variety of wireless communications applications, including wireless local loop (WLL) services, cellular mobile radiotelephone (CMR) services, and personal communications services (PCS). The antenna comprises a waveguide-implemented planar array of slot radiating elements, also described as slots, which are fed by a single feedpoint or launch point. Longitudinal slots are typically positioned in an axial sequence along the front and rear walls or plates of the waveguide body to achieve an omnidirectional radiation pattern. The waveguide axis is usually oriented in the vertical plane, and maximum radiation can occur in the horizontal plane. Significantly, the antenna may be manufactured from inexpensive materials processed by simple sheet metal forming methods, and the antenna may be assembled using procedures requiring relatively little time and skill. Consequently, the antenna provides cost advantages over prior art antennas providing similar gain and frequency spectrum characteristics.

Those skilled in the art will appreciate that the cost of communications antennas may constitute a significant portion of the total cost of deploying a wireless communications system, and that design techniques which provide for sufficient system performance while minimizing system cost are therefore desirable. For an antenna with a fixed, omnidirectional coverage requirement, an antenna designer will be typically presented with design objectives including a minimum gain requirement, the ability to withstand wind, rain and other environmental stresses, ease of installation, and minimum costs for materials, fabrication, and assembly.

It will be appreciated that an omnidirectional, flat-plate antenna formed by an array of waveguide slot radiators comprises a relatively low-profile antenna which can generate significant antenna gain within the azimuth plane. However, the expenses associated with antenna manufacturing and providing a feed distribution network for a slotted array antenna can be significant, and these expenses have previously precluded incorporating slotted array antennas into wireless communications systems. Advantageously, the present invention provides a slotted array antenna incorporating (1) a simplified feed which replaces the waveguide or microstrip feed structures utilized in prior antennas, (2) a reduced height waveguide implementation to minimize ripple in the radiation pattern, and (3) a manufacturing approach that relies upon simple, cost-effective sheet metal manufacturing processes.

Prior to discussing the embodiments of the antenna provided by the present invention, it will be useful to review the salient features of an omnidirectional antenna formed by a collinear array of waveguide slot radiators. An attractive feature of the slot as a radiating element in an antenna system is that an array of slots may be integrated into a feed distribution system without requiting any special matching network. For example, an energy distribution network, typically formed in a waveguide or stripline transmission medium, typically provides energy to each radiating element. Low-profile, high-gain antennas can be configured using slot radiators, although such antennas are generally bandwidth-limited by input VSWR performance.

A slot cut into the wall of a waveguide interrupts waveguide wall current flow and will couple energy from the waveguide into free space. Waveguide slots may be characterized by their shape and location on the wall of the waveguide and by their equivalent electrical circuits. A slot cut into a broad wall or face of a waveguide and oriented parallel to the direction of propagation interrupts only transverse currents and may be represented equivalently by a two-terminal shunt admittance. These slots are commonly known as shunt slots. By comparison, a slot cut into a broad wall of a waveguide, but oriented perpendicularly to the direction of propagation, will interrupt only longitudinal currents. This type of slot cut can be represented by a series impedance, and is hence commonly termed a series slot. Equivalent circuit conductance and susceptance values for particular shunt and series slots may be determined with the aid of measured data and design equations that are well known to those persons skilled in the art.

After individual slot element characteristics have been determined, the designer of a collinear, resonant slot array must specify slot locations and resonant conductances. This supports the design for an antenna impedance match and determines the aperture feed distribution. Slot spacing is limited by the appearance of grating lobes for slot spacings of one free-space wavelength or more and by the requirement that all slots be illuminated in-phase. To meet both requirements simultaneously, slots are typically spaced at one-half of the waveguide wavelength along the waveguide centerline and on alternating sides of the centerline. An array of shunt slots in each broad waveguide wall thus spaced will produce radiation polarized perpendicularly to the antenna axis.

The basic building block of a collinear resonant slot array is a single waveguide section having short circuit sections at each end and fed from the center of the waveguide. The number of slots in the waveguide is practically limited by input VSWR bandwidth and by array element pattern requirements. Basic design requirements include: (1) the sum of all normalized slot resonant conductances are nominally made to be equal to 2 for a center feed, and (2) the radiated power from each slot location is proportional to that slot's resonant conductance. The sum of all normalized slot resonant conductances may be made different from the matched condition to achieve a greater usable bandwidth or the feed network may have impedance transformation characteristics that can accomplish the matching. In the preferred embodiment of the antenna described below, the slots are designed to radiate equal power, so the resonant conductance of all slots is designed to be equal. To achieve an omnidirectional radiation pattern, longitudinal slots are positioned in both broad walls of the waveguide and are fed by a centrally-located feed point having a symmetrical implementation.

In a conventional resonant slot array, illumination of the slot elements is typically accomplished with either a waveguide center feed or a series slot, i.e., slots located in the narrow wall of a waveguide, each being fed in turn by a power divider network. Particularly for large arrays, the power divider network may become quite complex and may dominate total antenna cost. It is well known to those skilled in the art that judicious design of the power divider network is important in achieving a cost-effective antenna design. The present invention addresses these issues by using a single probe to provide a novel and economical feed distribution network for a planar resonant slot array antenna.

Turning now to the drawings, in which like reference numbers refer to like elements, FIG. 1 is a diagram illustrating the typical operating environment for a wireless RF communications system employing the preferred embodiment of the present invention. Referring to FIG. 1, in a wireless communications system 8, a directional antenna 12 in a communications cell 14 provides fixed point-to-point communication of RF signals to a fixed subscriber 16, a fixed communications facility 18, or adjacent communications cells 22. An omnidirectional antenna 10 associated with the communications cell 14 provides RF communications coverage to a mobile subscriber 20 within a geographic area surrounding the antenna. For a typical WLL application, the omnidirectional antenna 10 and the antenna 12 will be co-located within the same communications cell to permit signals received by the omnidirectional antenna 10 to be readily relayed to the directional antenna 12 and, likewise, signals received by the antenna 12 to be transferred to the omnidirectional antenna 10. In this manner, the signals received by the omnidirectional antenna 10 can be forwarded to the fixed subscriber 16, the fixed communications facility 18, or the adjacent communications cell 22 via the directional antenna 12.

Figure 3:
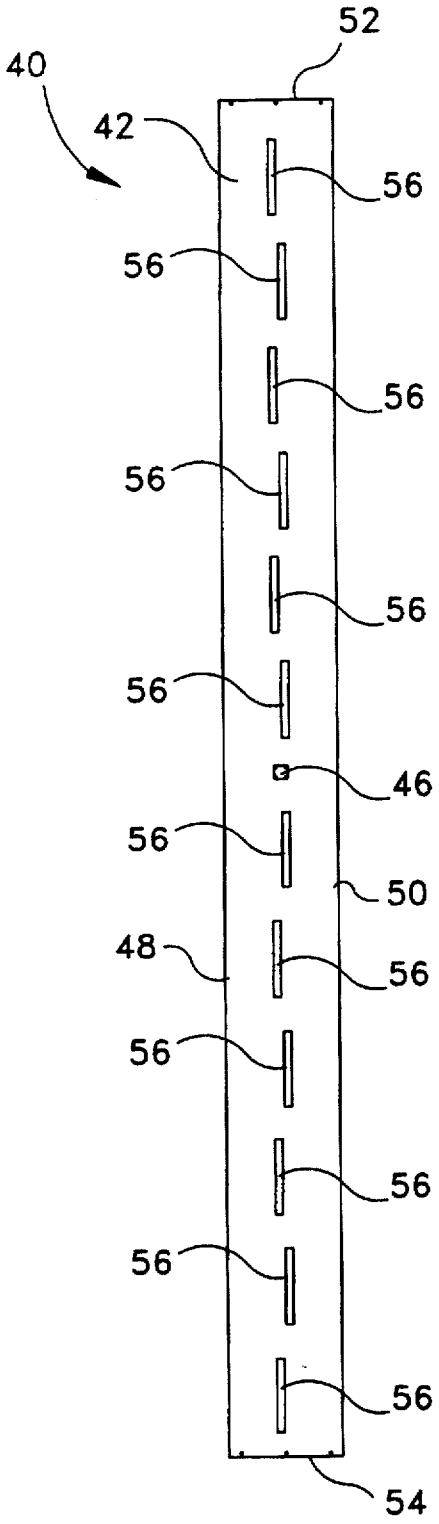
FIG. 3 is an illustration showing a rear view of an antenna for the preferred embodiment of the present invention.
Figure 4:
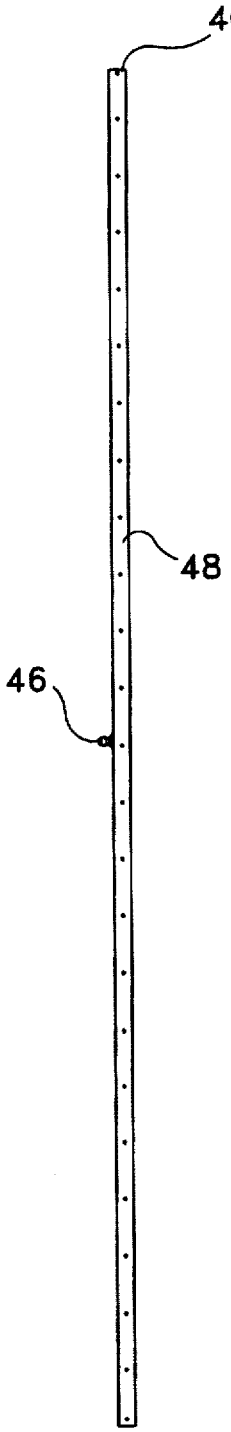
FIG. 4 is an illustration showing a side view of an antenna for the preferred embodiment of the present invention.

As will be described in detail below with respect to FIGS. 2–4, the antenna 10 is particularly useful for wireless communications systems requiring an antenna supporting omnidirectional communications coverage. The antenna 10 is preferably implemented as a waveguide antenna employing a set of planar arrays of waveguide slot radiators positioned in the broad walls of the waveguide. In particular, the antenna 10 provides a collinear, longitudinal-shunt slot array antenna having a parallel set of spaced-apart linear arrays fed by a single launch point and supplying moderate gain for the selected frequency spectrum of operation. This slotted array implementation of the antenna 10 supports a low profile based on its flat plate appearance and reduced height waveguide implementation. The preferred antenna avoids the need for a conventional power divider network design by using a probe to equally distribute the RF energy to the waveguide cavity of the antenna. In addition, the preferred antenna avoids the use of wings or extensions mounted along the narrow walls of the waveguide component by employing the reduced height waveguide implementation.

Figure 2:
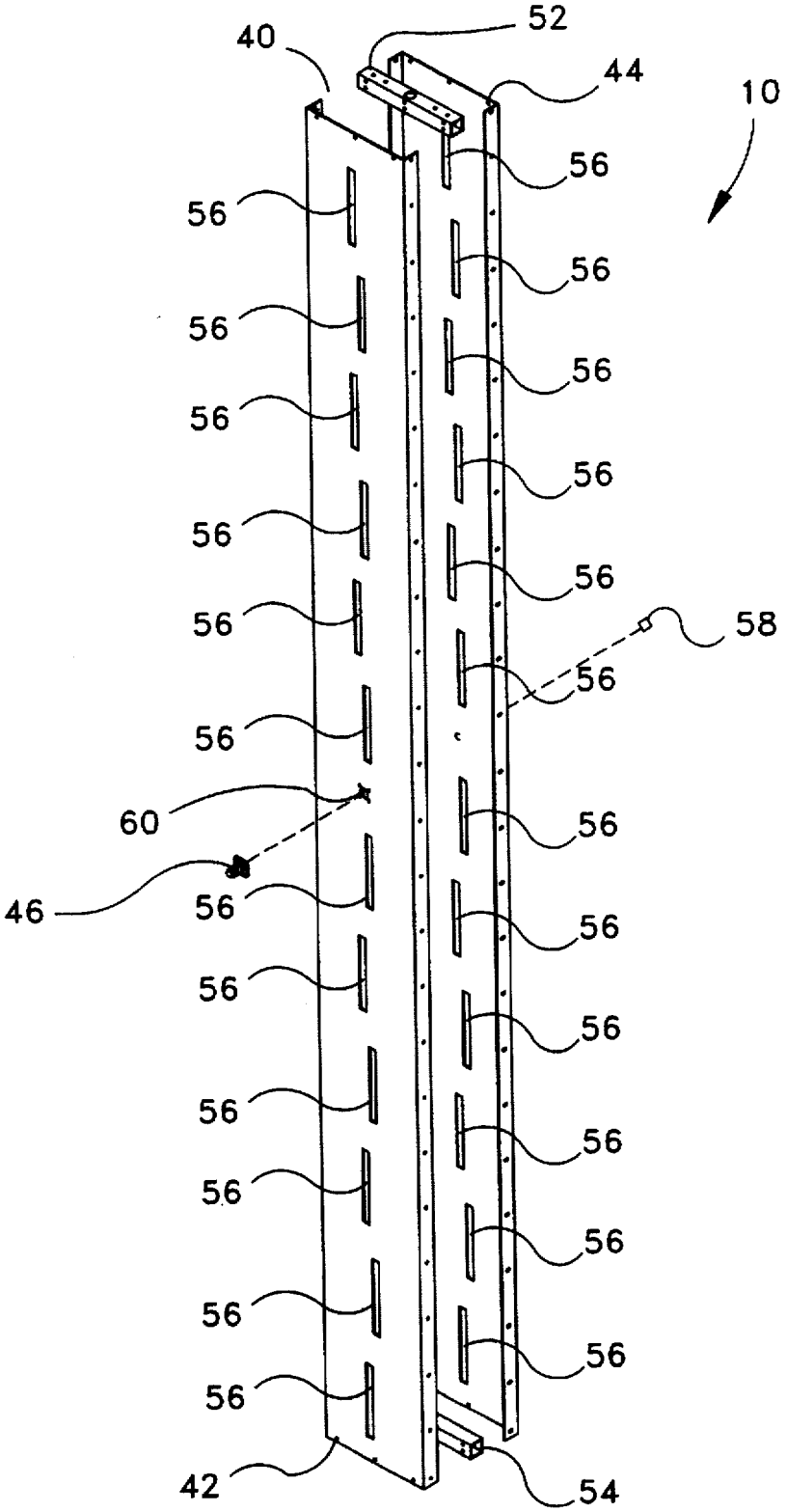
FIG. 2 is an illustration showing certain aspects of the assembly of an antenna for the preferred embodiment of the present invention.
Figure 5:
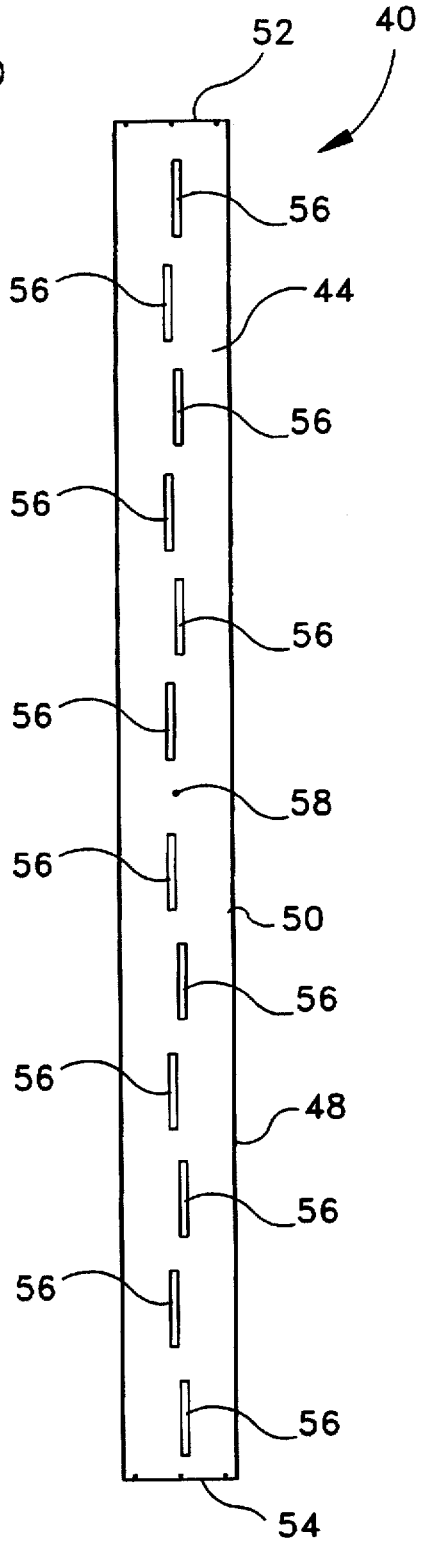
FIG. 5 is an illustration showing a front view of an antenna for the preferred embodiment of the present invention.

FIG. 2 is an exploded view illustration showing the assembly of the primary components of the antenna 10, and highlight the preferred construction of the antenna. FIGS. 3, 4, and 5, respectively, provide rear, side, and front views of the antenna 10. Referring now to a waveguide component 40 in FIGS. 2–5, a rear wall 42 and a front wall 44 are positioned in spaced-apart parallel planes and attached to spaced-apart side walls 48 and 50, thereby forming a waveguide-like cavity within an antenna assembly defined by the intersecting walls. The rear and front walls 42 and 44 have a minor dimension that is larger than the corresponding minor dimension of the side walls 48 and 50. Consequently, the rear and front walls 42 and 44 represent broad walls of the waveguide, whereas the side walls 48 and 50 represent narrow walls. For the preferred embodiment, the aspect ratio of the antenna 10, which is typically defined by the ratio of the width of the broad wall to the height of the narrow wall, is relatively large, typically 8:1. This reduced height waveguide implementation supports the reduction of ripple within the azimuth plane of the radiation pattern. This enables the antenna 10 to exhibit a more accurate omnidirectional radiation pattern. In contrast, prior slotted array antennas have used wings or extensions to reduce the azimuth pattern ripple and commonly exhibit an aspect ratio of 2:1.

End caps 54 and 52 are positioned at the ends of the waveguide component 40, thereby enclosing the cavity of the antenna 10. The end caps 54 and 52 operate as short circuit terminations for the waveguide cavity defined by the intersecting walls 42, 44, 50, and 48. Each of the walls 42, 44, 50, and 48 preferably comprise a conductive material, such as aluminum. Fasteners, typically rivets, can be used to connect the end caps 52 and 54 to the ends of the antenna assembly.

The rear and front walls 42 and 44 include radiating slots 56, which provide the radiating elements for the antenna 10 and can be modeled as dipole-type radiators. The configuration of slots 56 along the front wall 44, which is best shown in FIG. 5, are preferably spaced at one-half of the wavelength for the center operating frequency and placed along alternating sides of a centerline extending the major dimension axis of the front wall 44. The slots 56, which are shunt-type slots, produce radiation polarized perpendicularly to this major dimension axis. A similar configuration of slots 56 is shown in FIG. 5 for the rear wall 42. Specifically, the placement of the slots 56 along the rear wall 42 is substantially identical to placement of the slots 56 along the front wall 44 to achieve a symmetrical antenna pattern within the azimuth plane. It will be appreciated that the slots 56 are placed in both of the broad walls of the antenna 10 to achieve an omnidirectional radiation pattern. In contrast, slots 56 can be positioned in a single broad wall, such as the rear wall 42 or the front wall 44 to obtain a directional radiation pattern. Each slot 56 is cut into a broad wall and oriented parallel to the direction of signal propagation, thereby interrupting the transverse currents of the waveguide cavity.

For this reduced height waveguide implementation, the side walls 46 and 48 have a minor dimension that is much less than the minor dimension of the rear wall 42 or the front wall 44. As best shown in FIG. 4, the side walls 46 and 48 represent narrow walls of the waveguide component 40. Although the waveguide component 40 is preferably implemented as a rectangular waveguide, it will be appreciated that other types of waveguide configurations can be used for the present invention.

A probe assembly 46 distributes RF energy to the waveguide cavity and, in turn, this RF energy is passed to the slots 56. The probe assembly 46 is centrally located along the waveguide component 40 to provide a center-fed launch point for the antenna 10. The probe assembly 46 is preferably installed along the exterior surface of the rear wall 42 and extends within the cavity of the antenna 10 via a mounting opening 60 in the rear wall. For the preferred reentrant-type design, the probe assembly 46 includes a probe extension or post that extends from the rear wall 42 to the front wall 44. This extension extends through the front wall 44 and is mounted to the wall by a fastening device 58, such as a nut, positioned on the exterior surface of the front wall 44. This reentrant probe design is useful for matching the impedance presented by the mid-point of a single waveguide nm and serves as a shunt tee. It is characterized by the capability of matching a relatively wide range of impedances based on a symmetrical configuration. Specifically, the probe assembly 46 includes a high impedance coaxial-type reentrant section and a radial gap, located along the reentrant section, which provides a shunt capacitance. Thus, the probe assembly 46 can be modeled by a distributed element model representing an "LC" matching network.

The probe assembly 46 preferably has a symmetrical configuration and feeds RF energy into the waveguide cavity equally in phase and in amplitude. In this manner, the radiating slots 56 are fed in-phase. The waveguide cavity can be viewed as having a pair of sections, each corresponding to one of the waveguide halves of the waveguide component 40. The center point for these sections is preferably defined by the location of the probe assembly 46. Thus, a two-way feed network is provided by the present invention, which is a result of the symmetry of the structure of antenna 10 and the central placement of the probe assembly 46 on the waveguide component 40. As will be described in more detail below with respect to FIGS. 8–9, the symmetrical design features of the probe assembly 46 provide a proper impedance match for the load presented by the antenna 10.

Figure 6:
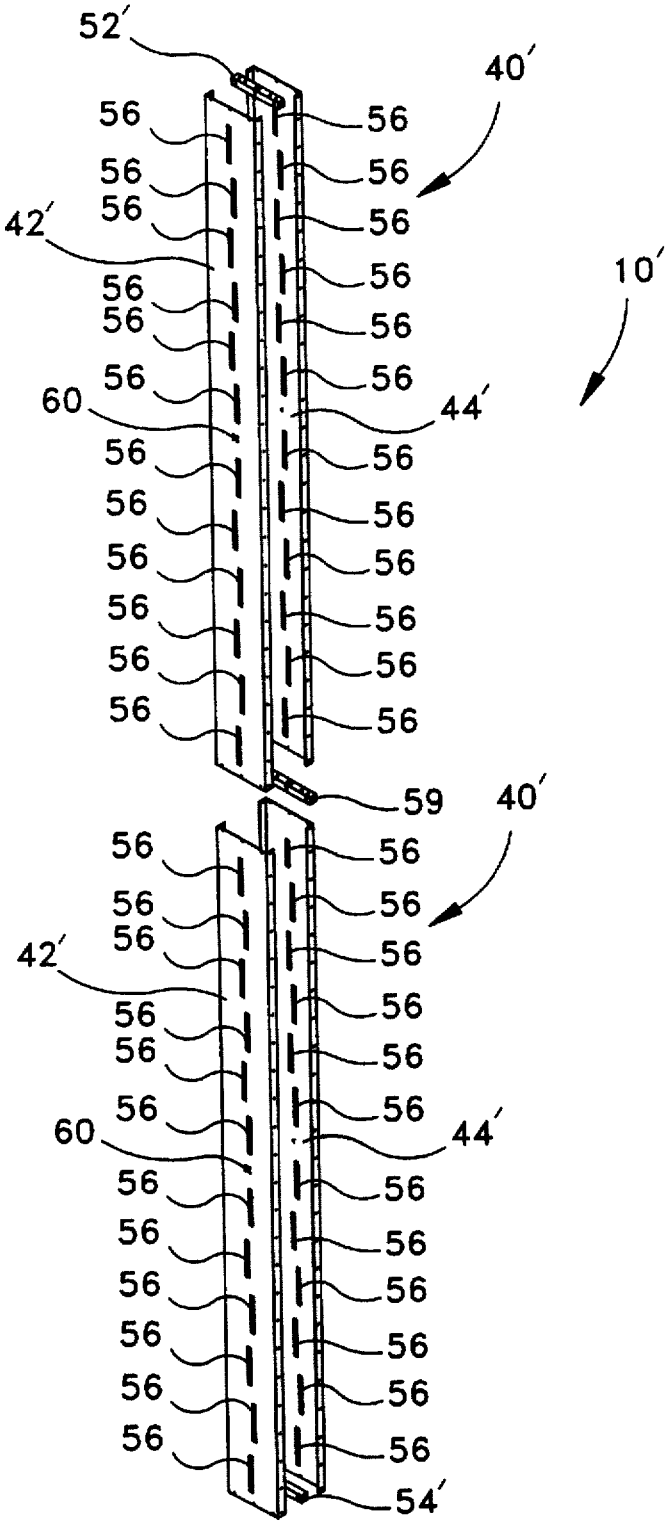
FIG. 6 is an illustration showing certain aspects of the assembly of an antenna for an alternative embodiment of the present invention.

It will be appreciated that the antenna 10 described above with respect to FIGS. 1–5 can be implemented as a modular antenna component. Modular construction supports the combination of two or more of these waveguide-implemented assemblies to attain a higher gain characteristic. Those skilled in the art will understand that increased gain is typically achieved by increasing the length of the waveguide-implemented antenna and, consequently, increasing the number of slots positioned along the increased antenna length. Turning now to FIG. 6, an antenna 10', which is characterized by an increased gain characteristic, comprises a pair of waveguide-implemented components 40', each having rear and front walls 42' and 44' and side walls 46' and 48'. The waveguide components 40' are stacked by connecting one end of a first waveguide component to an end of a second waveguide component, thereby forming a common junction between the two components. Each waveguide component 40' comprises a centrally located probe assembly 46 to distribute RF energy within the waveguide cavity of its corresponding component. The waveguide components 40' are identical in construction with the exception that each shares a common junction block 59 that terminates the respective ends at the junction of the two components 40'. The opposite ends of the components 40' are respectively terminated by a pair of end caps 52' and 54'. The end caps 52' and 54' and the junction block 59 operate as short circuit stubs at the terminated ends of the waveguide component 40'.

It will be appreciated that the overall electrical length of the antenna 10' is effectively halved by placing a short circuit stub at the common junction between the waveguide components 40'. The placement of the common junction block 59 at the junction between the waveguide component 40' effectively divides the antenna 10' into four sub-arrays, each having six slots 56. By dividing the antenna 10' into four sub-arrays, bandwidth is increased by a factor of four (4%) percent.

In addition, frequency scanning or squint is reduced by dividing the antenna 10' into a pair of the waveguide components 40', each having a centrally located probe assembly 46. Frequency scanning is reduced because each waveguide component 40' has a smaller electrical length than the overall length of the antenna 10'. Frequency scanning or squint reverses direction in each quadrant of the antenna 10' of the far field pattern, while the far field pattern remains broad side for the desired azimuth plane.

A down tilt of the antenna beam can be achieved by adding a relative phase difference between the pair of probe assemblies 46 of the antenna 10'. This phase difference can be achieved by using feed cables of slightly different electrical lengths to feed the probe assemblies 46. For example, a predetermined amount of down tilt can be achieved by a small difference in path lengths of a pair of feed cables connected to the probe assemblies 46 and a common in-phase power divider.

Figure 7:
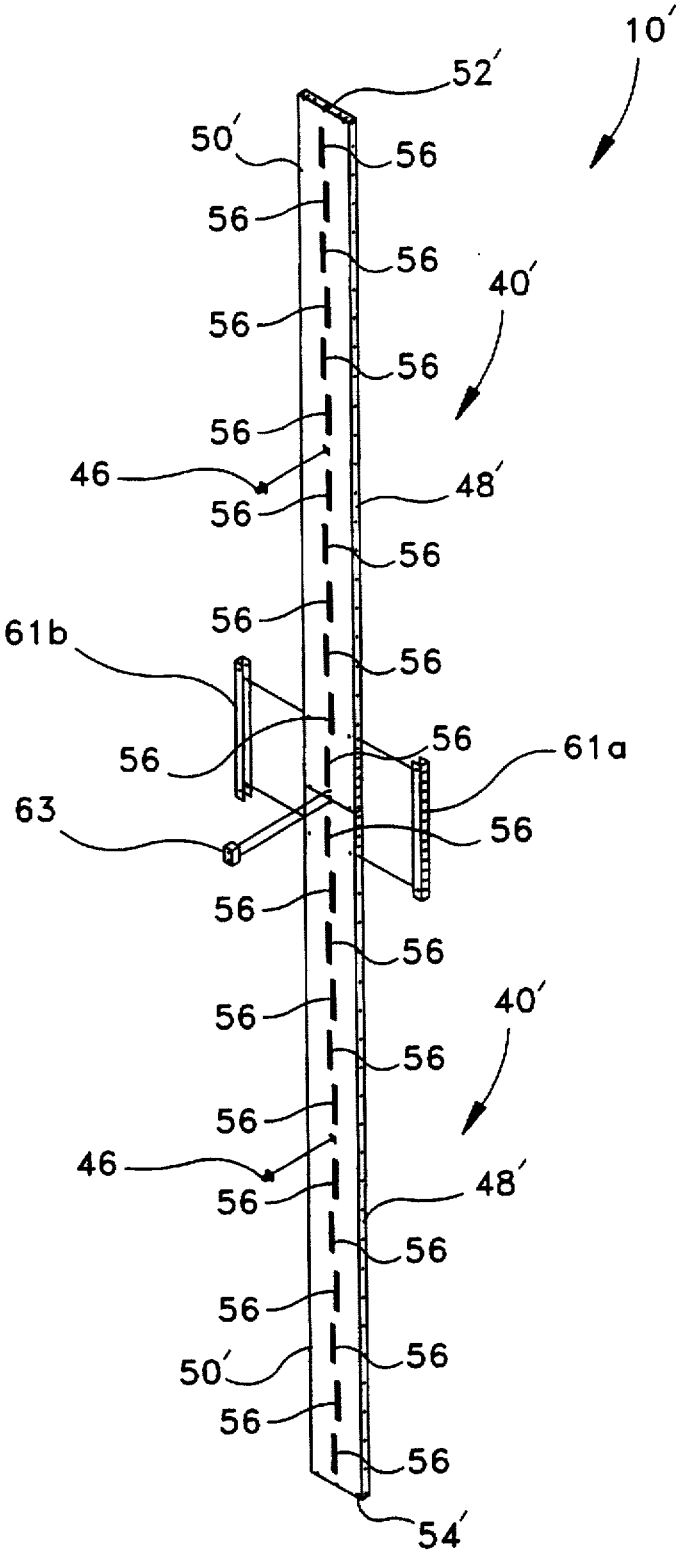
FIG. 7 is an illustration showing a perspective view of an antenna for the alternative embodiment of the present invention.

FIG. 7 is an illustration showing a perspective view of the antenna 10'. To provide structural support at the common junction formed by stacking the waveguide components 40', clamps 61*a* and 61*b* are connected to side walls of the waveguide components 40' at this common junction. Fasteners, typically rivets, can be used to mount the clamps 61*a* and 61*b* to the side walls 48' and 50'. In addition, a power divider can be added along the rear walls 42 at the common junction to provide a mechanism for connecting the coaxial cable feeds that extend to the probe assemblies 46. FIG. 7 also shows that the minor dimension of the rear and front walls 42' and 44' is greater than the minor dimension of the side walls 48' and 50' for the antenna 10'.

For this alternative embodiment, the antenna 10' provides at least 13 dB of gain over a frequency range of 1420 MHz to 1530 MHz. This gain figure may be accomplished by choosing piece-pan dimensions to yield approximate internal dimensions of the waveguide components 40' of 5.7 inches wide ×0.75 inches high ×70 inches long. The radiating slots 56 are nominally 3.974 inches long and 0.4 inches wide and are placed along the rear and front walls 42' and 44', which have a thickness of 0.062 inches. To provide environmental protection, the slots 56 can be covered by a radiating, waterproof material, such as 3M's "SCOTCH" brand 838 weather resistant film tape, which is applied to the exterior surface of the rear and front walls 42' and 44'.

Although FIGS. 6 and 7 illustrate a stacking of a pair of waveguide components 40' within the same vertical plane, it will be appreciated that one of the waveguide components 40' can be stacked at a 90 degree angle (in the vertical plane) relative to the remaining waveguide component to minimize ripple in the azimuth radiation pattern and to thereby obtain a more accurate omnidirectional pattern. Accordingly, an alternative embodiment comprises a pair of stacked waveguide components 40', wherein one of the waveguide components 40' is positioned at a 90 degree angle relative to the other.

Figure 8:
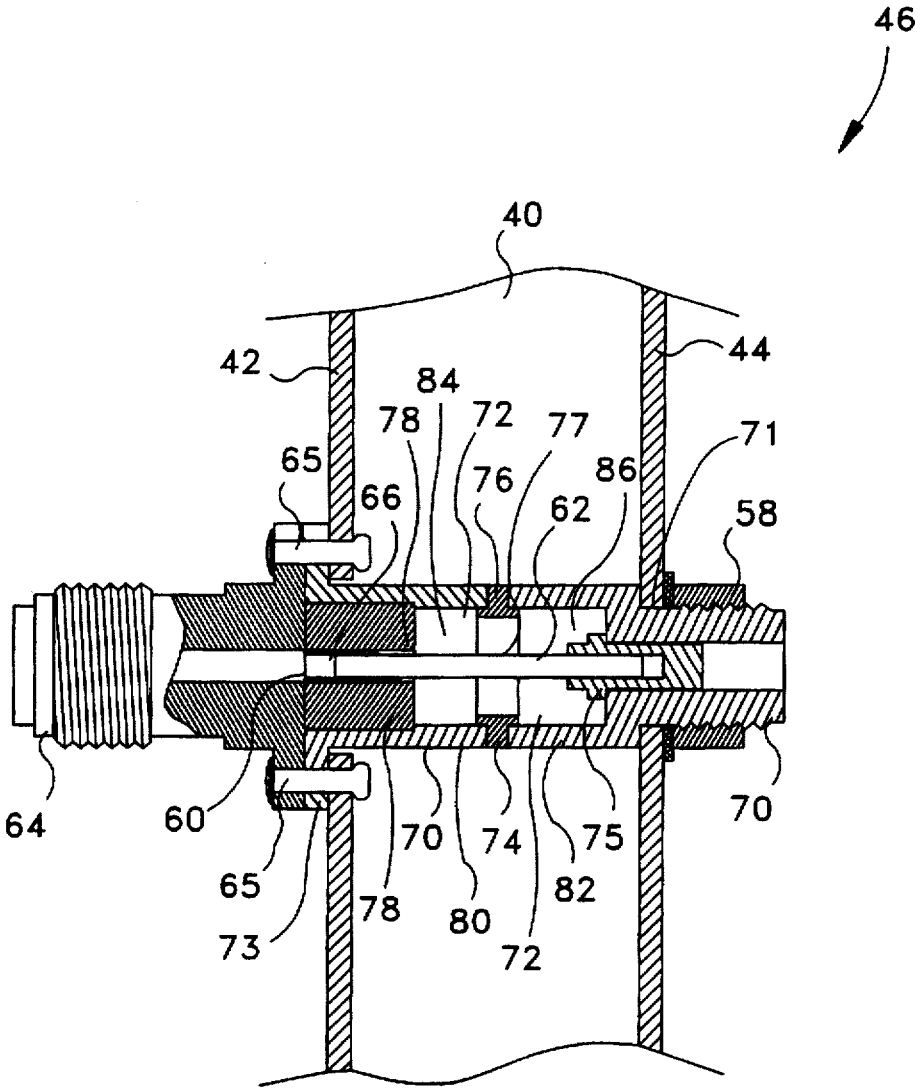
FIG. 8 is an illustration showing a cross-sectional view of a probe assembly for the preferred embodiment of the present invention.

FIG. 8 provides a cross-sectional view of the preferred probe assembly and its associated dimensions. The cross-sectional view is taken along the length of the probe assembly 46. Turning now to FIGS. 2 and 8, to couple energy from a RF transmitter and/or receiver to the radiating slots 56, the probe assembly 46 is mounted to the rear wall 42 using fasteners 65. The probe assembly 46 comprises a probe pin 62, an antenna connector 64, and an extension or post 70. The antenna connector 64 is connected to the exterior surface of the rear wall 42, whereas the probe pin 62 and the post 70 are installed within the waveguide cavity. The post 70 extends between the interior surfaces of the rear wall 42 and the front wall 44, and includes a post cavity 72 and a post slot 74. The post cavity 72 is a cavity positioned within the post 70 and extends along at least a portion of the length of the post 70. The post slot 74 is preferably positioned at the mid-point of the post 70 and includes an opening or gap that traverses the post. The probe pin 62 is inserted within the post cavity 72 to support the distribution of RF energy to the waveguide cavity via the post slot 74.

The probe pin 62 comprises a conductive material, such as type 303 Beryllium Copper, per QQ-C-530, gold-plated per MIL-G-45204. The probe pin 62 preferably has a symmetrical shape. For improved load matching performance, the preferred probe pin 62 has a cylindrical shape and a rounded tip on the probe end. However, the particular shape of the probe pin 62 is not critical so long as symmetry and correct impedance values are maintained. For example, a square or rectangular cross-section for the probe pin 62 can be used as an alternative to the preferred cylindrical shape. Specifically, the probe pin 62 could have a square cross-section of 0.050 inches to achieve the same impedance as a cylindrical pin having a diameter of 0.060 inches. Consequently, it will be understood that the present invention is not limited to a probe pin 62 or post 70 having a cylindrical shape, but can be extended to other symmetrical shapes.

The antenna connector 64 supports a cabled-connection of RF energy between a transmit and/or receive source and the antenna 10. The antenna connector 64, which is typically implemented as a coaxial-type receptacle, such as a TNC-type connector, can receive a male connector connected to the feed cabling. The antenna connector 64 includes a center conductor 66 that extends into the waveguide cavity via the mounting hole 60 on the rear wall 42, and can be directly connected to the probe pin 62. In this manner, RF energy can be distributed between the antenna connector 64 and the probe pin 62. The antenna connector 64 is typically connected to the surface of the rear plate 42 via fasteners 65, such as threaded mounting screws or rivets, thereby securing the probe assembly 46 to the antenna 10.

Alternatively, an electronic module (not shown) can be used in place of the antenna connector 64 to directly connect a receiver and/or a transmitter to the rear surface of the antenna 10. The electronic module is directly connected to the probe pin 62 to support the exchange of RF signals between the module and the antenna. This implementation eliminates any requirement for using an extended length of coaxial cabling to connect the receiver and/or transmitter to the antenna connector (and to the antenna).

The post 70, which preferably comprises conductive material, extends within the waveguide cavity and can be connected to the rear and front walls 42 and 44. The post 70 preferably has a symmetrical shape, such as a cylindrical or rectangular shape. For the preferred embodiment, one end of the post 70 extends through the mounting hole 60 on the rear wall 42 and is positioned adjacent to the exterior surface of the rear wall 42. Likewise, the opposite end of the post 70 extends through an opening 71 along the front wall 44 and is positioned adjacent to the exterior surface of the front wall 44. The post end located proximate to the rear wall 42 includes a flange 73 that is placed between the antenna connector 64 and the exterior surface of the rear wall 42. The fasteners 65 extend through openings in the antenna connector 64 and the rear wall 42 to mount the antenna connector 64 to the antenna 10. The opposite end of the post 70, which extends through the opening 71 of the front wall 44, includes threads and can accept a threaded stud or nut. This threaded end is secured to the front wall 44 by connecting the nut 58 to the threaded extension of the post 70. A lock washer can be placed between the nut 58 and the exterior surface of the front wall 44 to provide a secure connection of the post 70 to the front wall 44.

The central interior portion of the post 70 is hollow to form the cavity 72, which preferably extends along that portion of the post 70 within the waveguide cavity. At the rear wall 42, the center conductor 66 extends through the mounting hole 60 and into the post cavity 70. One end of the probe pin 62 is bonded to the center conductor 66. This connection between the probe pin 62 and the center conductor 66 is preferably achieved by a solder connection. The remaining end of the probe pin 62 is inserted within a receptacle 75, which is positioned at the opposite end of the cavity 72 and proximate to the front wall 44. Consequently, the probe pin 62 is secured within the cavity 72 by connecting the probe pin to the center conductor 66 and inserting the remaining end of the probe pin into the receptacle 75. The receptacle 75 is preferably a receptacle containing spring-mounted fingers that can grasp an item inserted within the receptacle, i.e., a press-in jack. The preferred receptacle 75 is manufactured by Concord of New York, N.Y. as Part No. 09-9100-1-04.

The post 70 is connected to the front wall 44 and, in turn, the receptacle 75 is connected to the post cavity 72. The probe pin 62 is electrically connected to the conductive surface of the front wall 44 by the receptacle 75. Specifically, a direct circuit (DC) connection is completed between the probe pin 62 and the front wall 44.

The post 70 also includes the post slot 74, which is preferably positioned at the mid-point of the post 70 and in between the rear wall 42 and front wall 44. For the preferred embodiment, the post slot 74 is a radial gap that extends along the surface of the post 70 and traverses the post cavity 72. Thus, the post 70 can be divided into two separate shells divided by a gap or opening provided by the post slot 74. The post cavity 70 is exposed to the interior of the waveguide cavity via the post slot 74. This allows the probe pin 62 to distribute RF energy to the waveguide cavity via the post slot 74.

The central location of the post slot 74, in combination with the symmetrical dimensions of the post 70, supports the distribution of RF energy with equal amplitude and phase to the slots 56 on the rear and front walls 42 and 44. Thus, the geometry of the probe assembly 46 supports the symmetrical distribution of current patterns along the walls 42 and 44 in the region adjacent to the probe. By equally distributing the RF energy on the walls 42 and 44, the slots 56 on both walls are illuminated to achieve the desired omnidirectional radiation pattern.

Those skilled in the art will appreciate that the performance of the symmetrical feed approach presented by the probe assembly 46 relies upon the symmetrical location of the probe pin 62, and the preferred central location of the port slot 74. This symmetrical design approach for the probe assembly 46 is critical for providing equal phase and amplitude RF signals to each broad wall of the antenna 10.

The probe pin 62 is preferably placed within the approximate center of the post cavity 72 and is held in place at both ends of the post 70. The remaining portion of the post cavity 72 can be filled with a dielectric material, such as air. The combination of the post pin and the post cavity 72 can be characterized as a coaxial-type reentrant section that presents a series inductance to the waveguide cavity. In addition, the post slot 74 represents a shunt capacitance to the waveguide junction. Thus, the probe assembly 46 can be viewed as an "LC" matching network for presenting a desired impedance to the waveguide cavity of the antenna 10.

A dielectric spacing element 76 can be positioned within the post slot 74 to provide a mechanism for varying the impedance provided by the probe assembly 46. The dielectric spacing element 76, which is preferably bonded to the edges of the post slot 74, comprises an opening to allow the probe pin 62 to extend through the dielectric spacing element. Thus, the dielectric spacing element 76 can be constructed as a dielectric bead or spacer with a centrally located clearance opening 77. The clearance opening 77 is sufficiently large to allow the probe pin 62 to extend through the dielectric spacing element 76. This opening within the dielectric spacing element 76 preferably has the same symmetrical shape as the probe pin 62.

The dielectric spacing element 76 comprises a selected dielectric material, preferably "ULTEM", "TEFLON", or any low loss, plastic material having a low hydroscopic characteristic. Those skilled in the art will appreciate that the dielectric constant of the dielectric spacing element 76 can be empirically determined to achieve the desired impedance value.

A dielectric tuning element 78 can be placed within the post cavity 72 and adjacent to the antenna connector 64 to provide an additional mechanism for varying the overall impedance provided by the probe assembly 46 to the waveguide cavity of the antenna 10. The dielectric tuning element 78, which comprises a dielectric material characterized by predetermined dielectric constant, includes an opening of sufficient size to allow the center conductor 66 to extend through the element. The dielectric tuning element 78 is preferably placed at one end of the post cavity 72 and includes a clearance opening 79 to allow passage of the center connector 66 (and the probe pin 62) within the post cavity 70. The dielectric tuning element 78 is preferably positioned proximate to the rear wall 42. The dielectric tuning element 78 presents another shunt capacitance to the waveguide cavity, thereby providing another opportunity to tone the overall impedance of the probe assembly 46.

The preferred dielectric material for dielectric tuning element 78 is "TEFLON". Alternative dielectric materials for the dielectric tuning element 78 can include "ULTEM" or any low loss, plastic material having a low hydroscopic characteristic. Those skilled in the art will appreciate that the dielectric constant and the dimensions of the dielectric tuning element 78 can be empirically determined to achieve the desired impedance matching performance.

For the preferred embodiment, the post 70 is divided into two separate components, a first shell 80 and a second shell 82. The first shell 80 is connected to the rear wall 42 and extends into the waveguide cavity of the waveguide component 40. The first shell 80 has a first shell cavity 84 located within and extending along at least a portion of the first shell 80. The second shell 82, which is connected to the front wall 44 and extends into the waveguide cavity, has a second shell cavity 86 located within and extending along at least a portion of the second shell. The second shell 82 is aligned in position with the first shell 80, thereby placing the first shell cavity 84 in central alignment with the second shell cavity 86. However, the first and second shells 80 and 82 are separated by a distance defining a radially-shaped opening or gap designated as the post slot 74.

The dielectric spacing element 76 is positioned between the first and second shells and adjacent to the probe pin. Specifically, the dielectric spacing element 76 is bonded to the first and second shells 80 and 82 and positioned within the post slot 74. The dielectric tuning element 78 is located within the first shell cavity 84 and adjacent to the rear wall 42. The center conductor 66 extends into the first shell cavity 84 via the mounting opening 60 within the rear wall 42, and is connected to the probe pin 62. The probe pin 62 is inserted within the first shell cavity 84 and the second shell cavity 86 for coupling RF energy to the waveguide cavity. Consequently, the probe pin 62 extends through the dielectric spacing element 76 and the dielectric tuning element 78 via the clearance openings 77 and 79.

Those skilled in the art will appreciate that some frequency scaling of the probe dimensions shown in FIG. 8 is possible. To scale successfully, all dimensions should be scaled. However, unlike the sheet metal thickness and antenna connector diameters, many of the probe dimensions that control the impedance value are not conveniently scalable. For this reason, those skilled in the art will appreciate that design dimensions for the preferred probe assembly at frequencies distant from 1500 MHz will not scale well, and that the use of modeling tools will be required to implement the preferred probe assembly at those other frequencies. To design the physical dimensions to accomplish such an impedance match, a modeling tool such as Hewlett-Packard's model 85180A HFSS modeling tool, or an equivalent modeling tool, is again very useful. Using the HFSS modeling tool, those skilled in the art can determine proper dimensions for the probe assembly 46.

Figure 9:
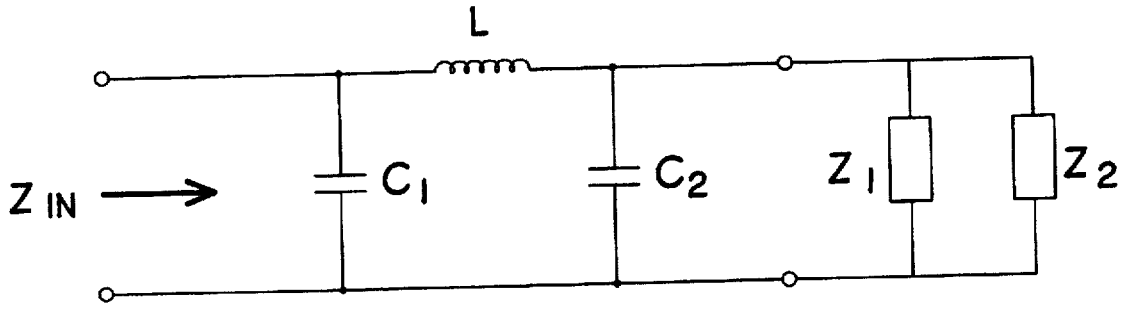
FIG. 9 is a schematic showing an equivalent electrical circuit for a probe assembly for the preferred embodiment of the present invention.

Referring now to the probe equivalent circuit shown in FIG. 9, the challenge presented by the probe design is matching a standard 50 ohm transmission line impedance, which is presented by the antenna 10 at the antenna connector 64, to the shunt impedances $Z_1$ and $Z_2$ that represent the symmetrically-fed collinear resonant slot array. The preferred probe assembly 46 can be schematically represented by an "LC" circuit comprising $L_1$, $C_1$, and $C_2$ components, whereas the load associated with the waveguide sections are schematically represented by the two shunt impedances $Z_1$ and $Z_2$. By designing the physical dimensions of the combination of the probe pin 62, the post cavity 70, the post slot 74, and the dielectric spacing element 76 to provide the appropriate values of the series inductance $L_1$ and the shunt capacitance $C_1$, the two waveguide shunt impedances can be matched to the desired 50 ohm transmission line impedance. However, to provide additional flexibility for matching the waveguide shunt impedances to the transmission line impedance, the dielectric tuning element 78 can be positioned at one end of the post cavity 70 adjacent to a broad wall of the antenna 10. The combination of the probe pin 62 passing through the dielectric tuning element 78 presents an additional shunt capacitance $C_2$ to the waveguide cavity. With the addition of the dielectric tuning element 78, the "LC" circuit can be modeled by a series inductance $L_1$ conducted between shunt capacitances $C_1$ and $C_2$.

Figure 10A:
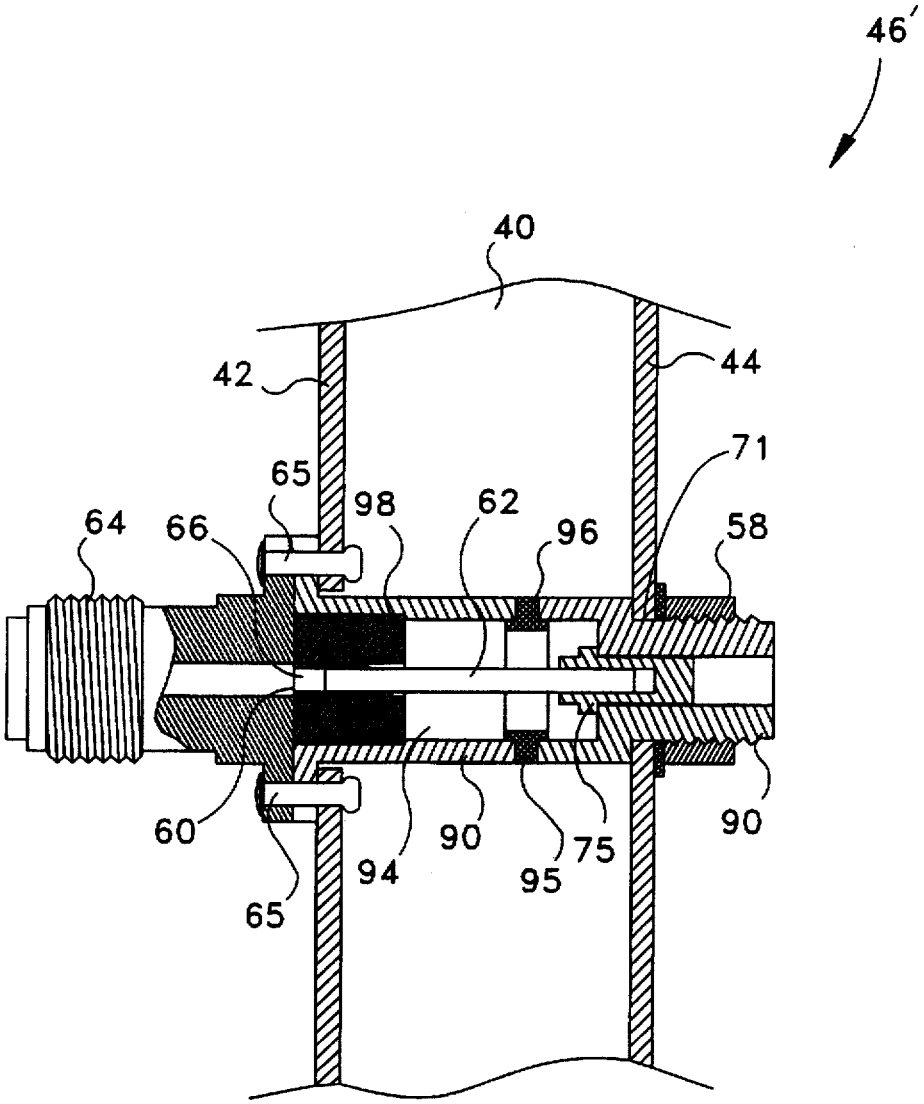
FIGS. 10A, 10B and 10C, are illustrations showing a cross-sectional view of a probe assembly for an alternative embodiment of the present invention.

An alternative embodiment for a reentrant-type probe assembly is shown in FIG. 10A. Referring now to FIGS. 2 and 10A, the probe assembly 46' is similar to the previously described probe assembly, with the exception that the post opening is now positioned closer to one end of the post and adjacent to the broad walls. Because the post opening is not located at the mid-point of the wave guide cavity, this alternative probe assembly 46' is more suitable for use with a directional coverage antenna having slots located along one of the two broad walls.

Turning now to a review of the probe assembly 46' in FIG. 10A, the antenna connector 64 is mounted to one of the broad walls, in this case, the rear wall 42, and the center conductor 66 enters the waveguide cavity via the mounting hole 60 on the rear wall 42. A post 90 extends between the rear and front walls 42 and 44, and is centrally located within the waveguide cavity. Thus post 90 includes a post cavity 94 that extends along at least a portion of the interior of the post. The probe pin 62 is connected to the center conductor 66 and extends within the opposite end of the post cavity 94. The probe pin 62 is secured within the post cavity 94 by connecting one end to the center conductor 66 and inserting the other end within the receptacle 75. The post 90 further includes a post slot 95 positioned at one end of the post and adjacent to one of the broad walls, in this case, the front wall 44. Significantly, the post slot 95 is positioned adjacent to one of the broad walls, rather than at the mid-point of the post 90, to support the distribution of current along that broad wall. A dielectric spacing element 96 can be inserted with the post slot 95 for varying the impedance presented by the probe assembly 46'.

Figure 10B:
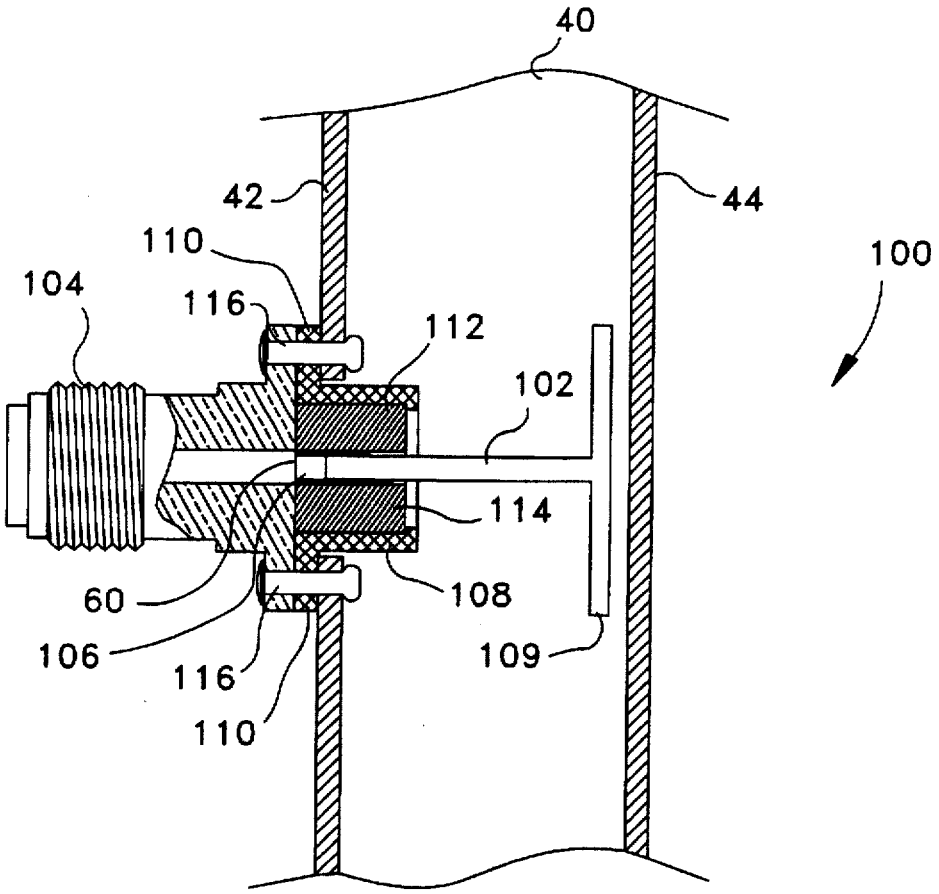
Figure 10C:
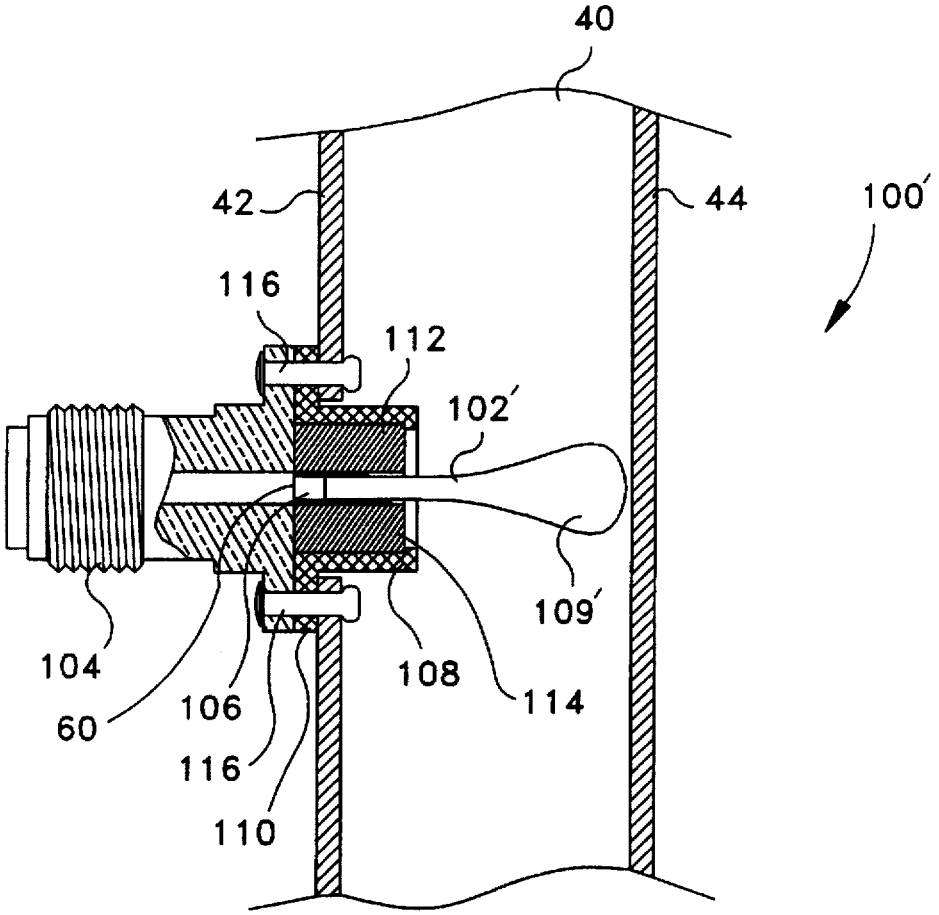

FIGS. 10B and 10C present cross-sectional views of alternative embodiments for a probe assembly for use with a waveguide-implemented slotted array antenna. Turning first to FIG. 10B, the probe assembly 100 comprises a T-shaped probe pin 102, an antenna connector 104 having a center conductor 106, and a shell 108 having a flange 110. The flange 110 of the shell 108 is positioned between the antenna connector 104 and the exterior surface of the rear wall 42. The antenna connector 104 is connected to the rear wall 42 via fasteners 116, such as rivets or threaded screws. The probe assembly 100 is preferably positioned at the center point of the waveguide component 40, thereby placing the pin 102 within the central portion of the waveguide cavity. The center conductor 106 of the antenna connector 104 extends within the waveguide cavity via the mounting hole 60 and is connected to the pin 102. The remaining end of the pin 102 is positioned proximate to the interior surface of the front wall 44 and includes a disk or plate 109 that extends parallel to the front wall 44 to provide capacitive end loading. In this manner, the pin 102 distributes RF energy within the waveguide cavity of the waveguide component 40.

The shell 108 comprises the flange 110, which is located on the exterior surface of the waveguide component 40, and the remaining portion of the shell 108 extends within the waveguide cavity. The shell 108 includes a cavity 112, which is defined by an opening within the interior of the shell 108 and extending along at least a portion of the length of the shell 108. The pin 102, which is connected to the center conductor 106, preferably extends through the shell cavity 112 and into the waveguide cavity. The shell cavity 112 can be filled with a dielectric material, such as a dielectric tuning element 114, which is useful for tuning the impedance presented by the probe assembly 100. The dielectric tuning element 114 preferably includes a clearance hole to allow a combination of the center conductor 106 and the pin 102 to extend through the dielectric tuning element.

It will be appreciated that within the vicinity of the probe assembly 100, the capacitive end loading of probe 100 against front wall 44 will cause the current distributions on walls 42 and 44 to be different. Those skilled in the an will appreciate that this configuration would be best used in a directional antenna with slots on one wall only to avoid the problem of different current distributions. Those skilled in the art will appreciate that the spacing between the plate 109 and the front wall 44 can be adjusted to present the desired impedance to the waveguide cavity.

Turning now to FIG. 10C, an alternative probe assembly 100' is shown for use with a waveguide-implemented slotted array antenna. The probe assembly 100' is similar to the probe assembly of FIG. 10B, with the exception that the pin 102' comprises a bulb-shaped end instead of a plate. The rounded surface increases peak power capability. The bulb-shaped end 109' is positioned proximate to the interior surface of the front wall 44 to support the distribution of RF energy within the waveguide cavity. Similar to the probe assembly 100, the probe assembly 100' is particularly useful for antennas with slots on one wall only, and thus for an antenna exhibiting a directional antenna pattern.

Figure 11A:
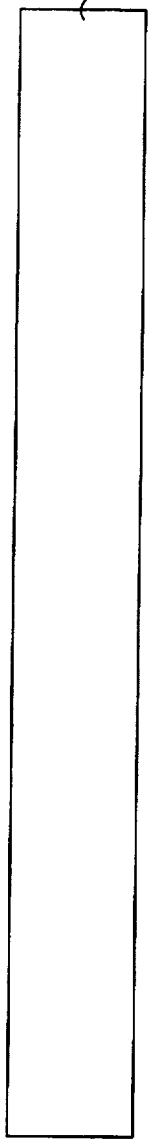
FIGS. 11A, 11B, and 11C, are illustrations showing the incremental stages for manufacturing a portion of a waveguide assembly for an antenna for the preferred embodiment of the present invention.
Figure 11B:
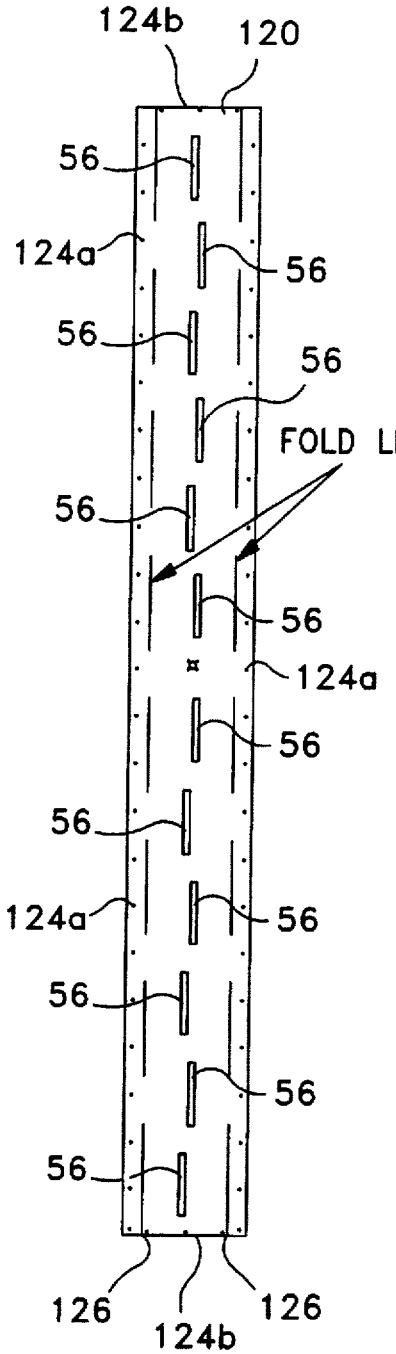
Figure 11C:
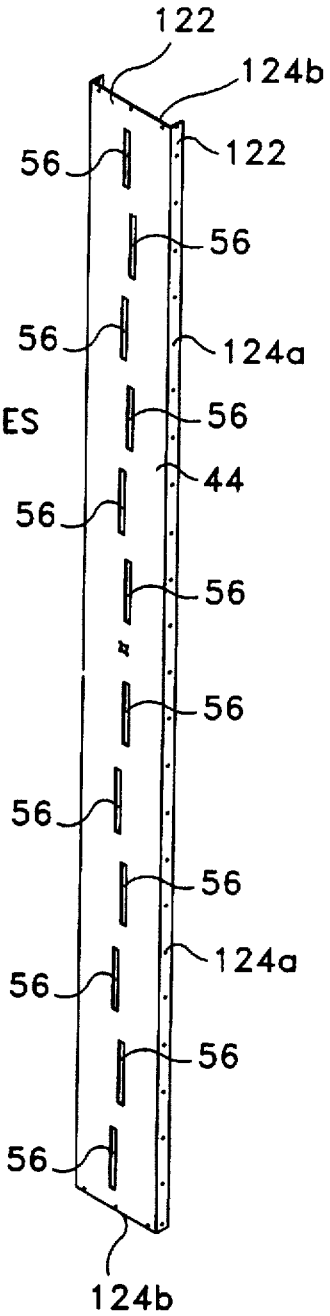

One of the advantages of the antenna and associated probe assembly provided by the present invention is that the antenna 10 is amenable to manufacturing and assembly at very low cost. The preferred manufacturing process for the antenna 10, including the probe assembly 46, is shown in FIGS. 11–15. FIGS. 11A, 11B, and 11C, collectively described as FIG. 11, illustrate the tasks for manufacturing a portion of the waveguide for the preferred embodiment of the antenna 10. Turning now to FIGS. 2–5 and 11, the manufacturing process starts with appropriate raw materials available for construction of the antenna 10. The waveguide component 40 is assembled from two plates 120 of sheet metal, each having a broad wall, such as the rear wall 42 or the front wall 44, and a pair of wings 122 connected to the broad wall. The wings 122 are spaced-apart by the distance extending along the minimum dimension of the broad wall to form a preferred U-shaped section. Although FIG. 11 shows only a single sheet metal plate, it will be understood that both plates are created in similar manner, and that the plate 120 shown in FIG. 11 is representative of a plate having the rear wall 42 or the front wall 44.

To construct these sections, first and second plates 120 are stamped from flat sheet metal stock, as shown in FIG. 11A. The first plate **120*a* preferably has a minor dimension that is slightly greater than a corresponding minor dimension of the second plate 120*b*. Both plates 120 preferably have a rectangular appearance defined by a major dimension along a vertical axis that is greater than the minor dimension along a horizontal axis. Each plate 120** is stamped from flat sheet metal stock, preferably 0.062 inches thick aluminum 3003-H14.

Figure 12:
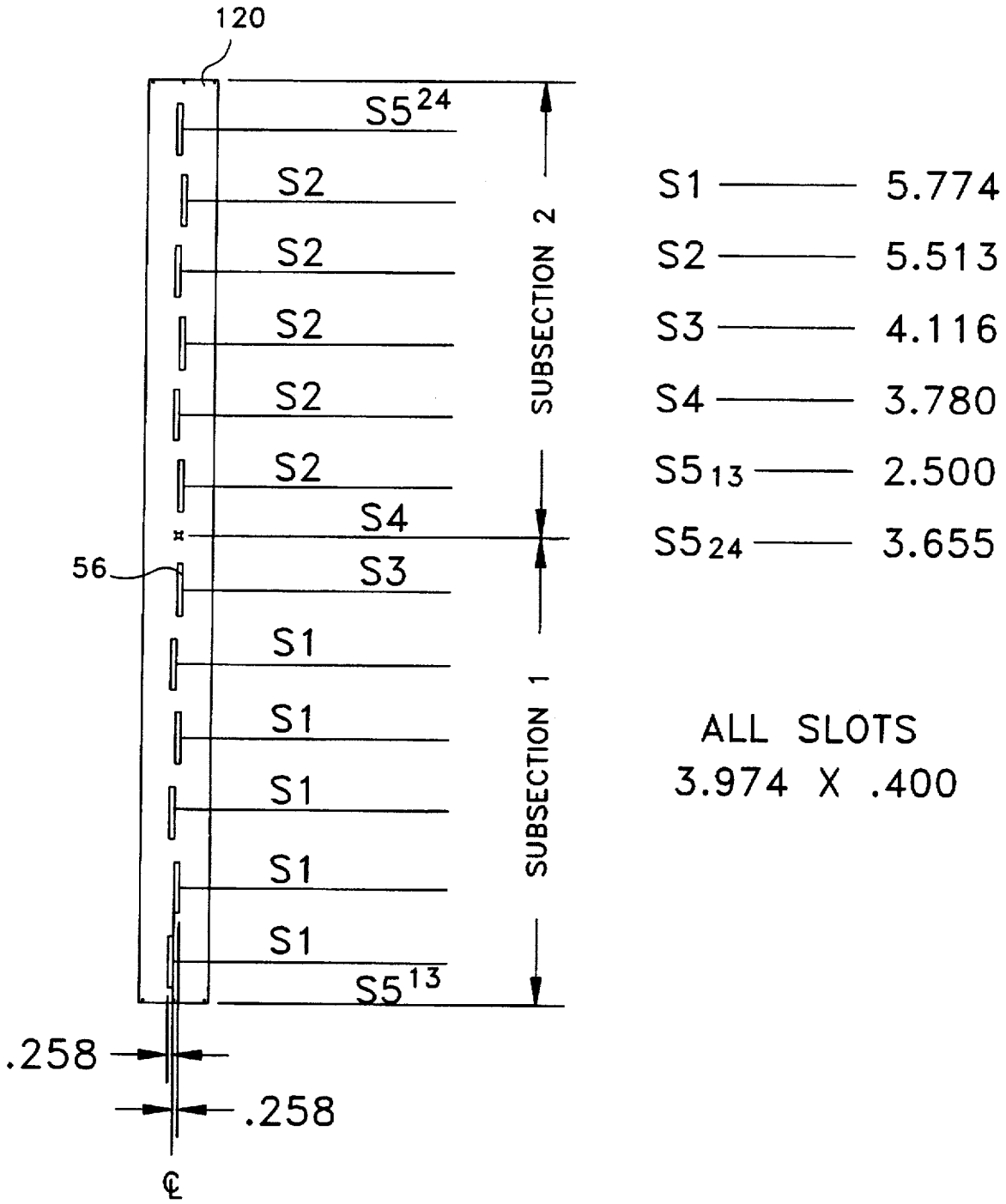
FIG. 12 is an illustration showing the placement of slot elements along a broad wall of the an antenna for the preferred embodiment of the present invention.

FIG. 12 is an illustration showing a face of one of the plates 120, such as the rear wall 42 or the front wall 44, and the placement of slots along the plate 120. Turning now to FIGS. 11B and 12, the slots 56, the mounting holes for the probe assembly 46, and fastening holes are punched into each plate 120. The slots 56 are positioned at predetermined intervals along the vertical axis for each plate 120 to achieve a desired radiation pattern. In particular, the slots 56 are placed along the portion of a plate 120 that will form a broad wall of the waveguide component 40, such as the rear wall 42 or the front wall 44. Each slot 56 has a length of 3.974 inches and a width of 0.40 inches. At the top of the plate 120, the center point for the slot 56 is spaced 3.655 inches from the edge of the plate. In contrast, at the bottom of the plate 120, the center point for the slot 56 is spaced 2.5 inches from the edge of the plate. Thus, it will be appreciated that a plate 120 can be viewed as having a top edge and a bottom edge for the placement of the slots 56. Similarly, the slot 56 adjacent to and above the probe assembly 46 is centered at a location on the plate 120 that is 3.780 inches above the center mounting hole for the probe assembly. In contrast, the slot 56 adjacent to and below the probe assembly 46 is centered at a location on the plate 120 that is 4.116 inches below the center mounting hole for the probe assembly. The slots 56 are placed in alternating fashion on either side of a center line extending along the main dimension of the plate 120, namely 0.258 inches from the center line.

Still referring to FIG. 11B, the mounting holes for the probe assembly 46 are placed at an approximate center point of one of the plates 120. In addition, fastener holes 124 are punched along the periphery of each plate. Specifically, a first set of fastener holes **124*a* is positioned at periodic intervals along the major dimension of the first and second wings; and a second set of fastener holes 124*b* is placed along the minor dimension at the ends of each plate. The fastener holes 124 have a size sufficient to accept a fastener 127**, such as a rivet or a screw.

Turning now to FIG. 11C, U-shaped sections are created by folding edges of the plates **120*a* and 120*b* along fold lines 126, which are represented by the dashed lines on the plate. The first and second plates 120*a* and 120*b* are folded at fold lines 126 to respectively form a first U-shaped section and a second U-shaped section. The first U-shaped section has the front wall 44 and a pair of first wings 122*a* extending from either side of the front wall. A minor dimension of the front wall 44 is greater than a corresponding minor dimension of each first wing 122*a*. For the second U-shaped section, a pair of second wings 122*b* extend from either side of the rear wall 42. A minor dimension of the rear wall 42 is greater than a corresponding minor dimension of each second wing 122*b*. Thus, the first U-shaped section has a minor dimension that is slightly greater than a corresponding minor dimension of the second U-shaped section. This allows the second U-shaped section to be placed within the first U-shaped section, as best shown in FIG. 14, to form the waveguide component 40**.

Figures 13, 13A, 13B:
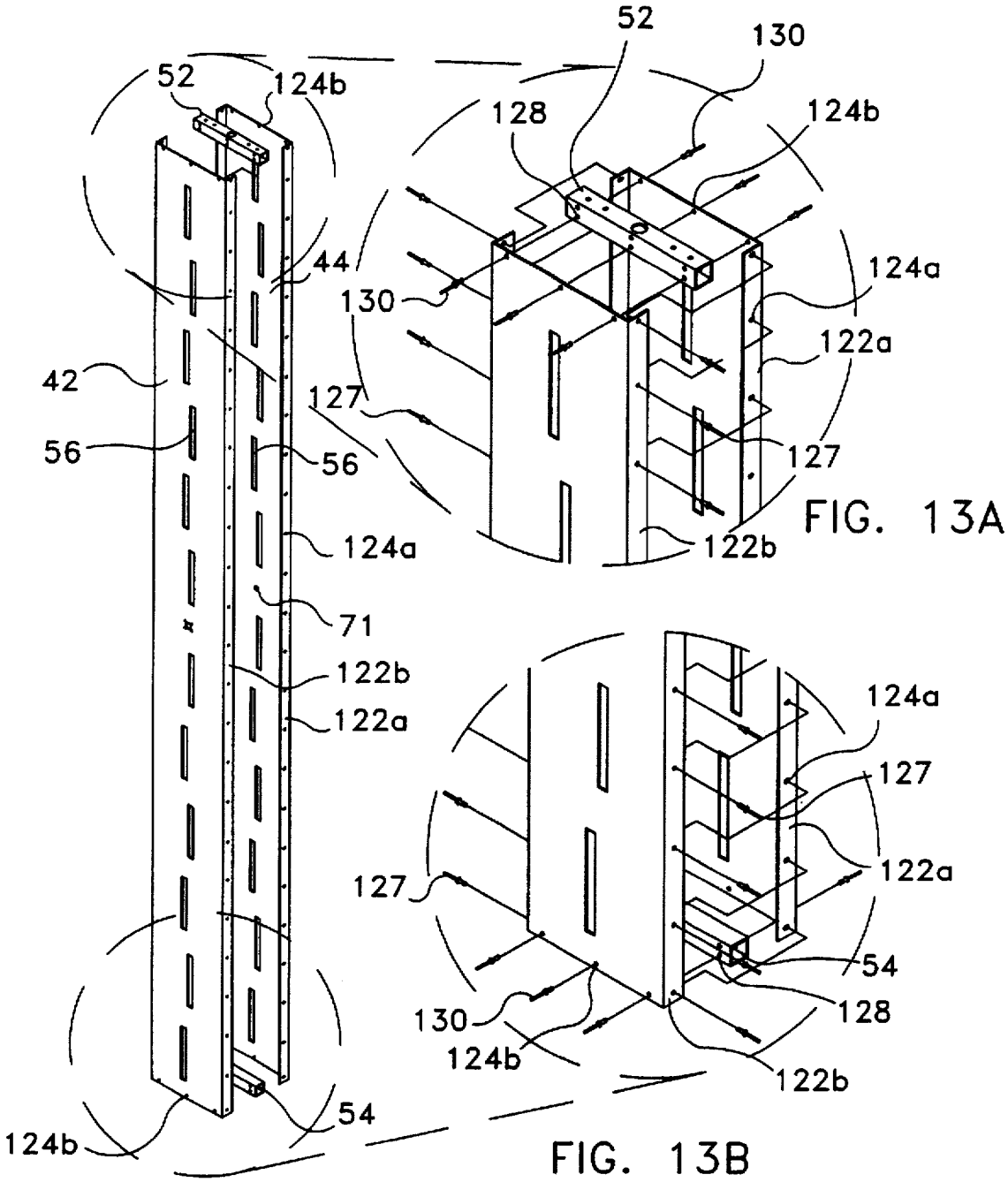
FIG. 13 is an illustration showing the assembly of the waveguide component of an antenna for the preferred embodiment of the present invention.
FIG. 13A is an enlarged view of the top portion of the assembly of the waveguide component shown in FIG. 13.
FIG. 13B is an enlarged view of the bottom portion of the assembly of the waveguide component shown in FIG. 13.
Figure 14:
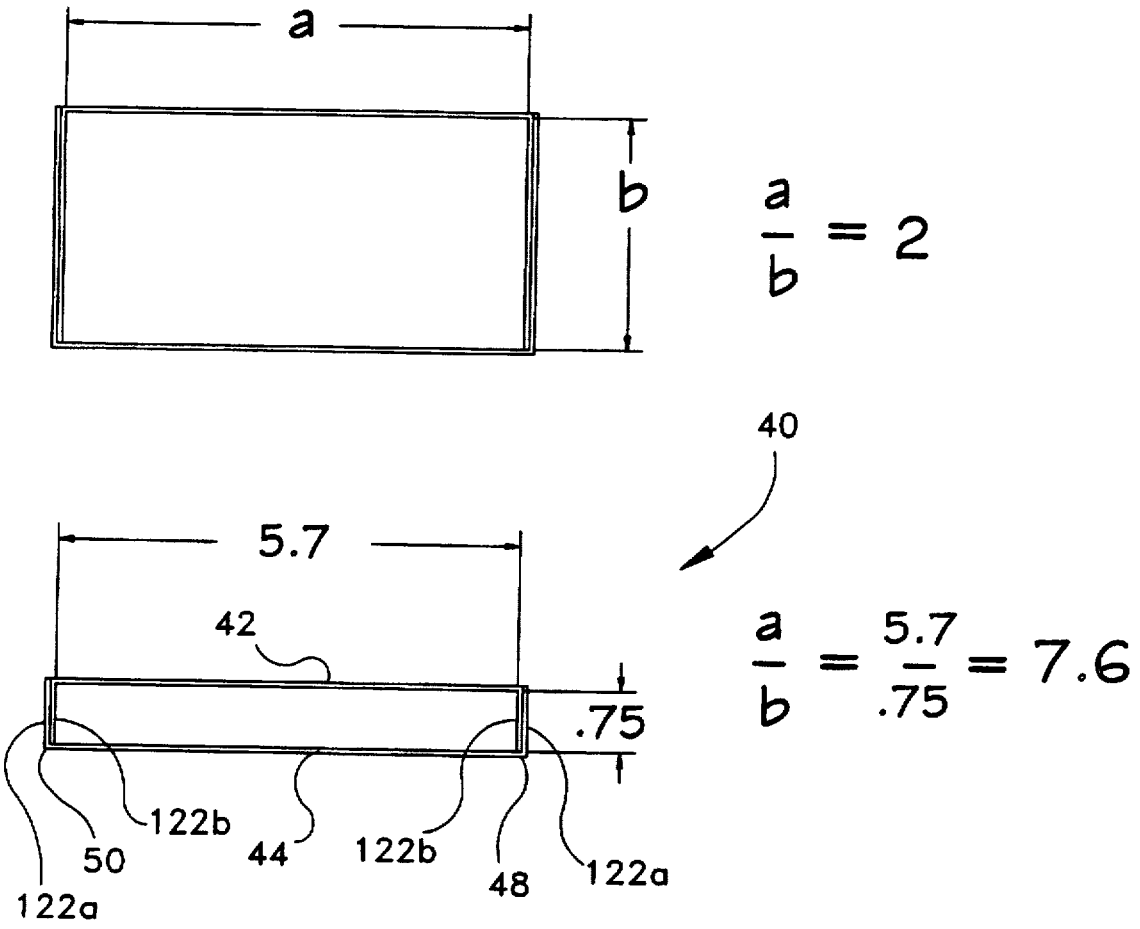
FIG. 14 is a diagram showing a cross sectional view of a representative waveguide component having a width of "a" and having a height of "b".

A waveguide cavity is created by placing the second U-shaped section within the first U-shaped section, as shown in FIGS. 13 and 14. The second U-shaped section is placed within the first U-shaped section, thereby placing the wings 122b of the second section adjacent to the corresponding wings 122a of the first section. This combination of first and second wings 122a and 122b results in the formation of the side walls 48 and 40 of the waveguide component 40. The fastener holes 124a in the first and second wings 122a and 122b are aligned, and fasteners 127 inserted to secure the first and second sections, as best shown in the enlarged views presented in FIGS. 13A and 13B.

FIG. 14 is an illustration showing a cross sectional view of the waveguide component for the antenna 10. Referring still to FIGS. 13 and 14, the aspect ratio for the waveguide component 40 is defined by the ratio of the minor dimension of one of the broad walls 42 or 44 to the minor dimension of one of the side walls 48 or 50. If "a" is defined as the minor dimension for the rear wall 42 and "b" is defined as the minor dimension for the side wall 48, then the aspect ratio of "a\b" is approximately 8 (5.7 inches\0.75 inches). In contrast, the aspect ratio for the waveguide component of a conventional slotted array antenna is "2". The antenna 10 realizes an improvement in the azimuth radiation pattern by using reduced height waveguide to reduce the ripple or directivity in this radiation pattern. By reducing the height at the side walls 48 and 50, ripple in the azimuth radiation pattern is reduced without the use of extensions or wings attached along the exterior faces of the side walls. Thus, a low profile slotted array antenna exhibiting a true omnidirectional coverage characteristic is achieved by the use of a reduced height waveguide.

End caps 52 and 54 for the waveguide cavity are manufactured by extruding a selected metal stock. The end caps 52 and 54 are sized to respectively fit at the top or bottom ends of the waveguide component 40. Each end cap 52 and 54 has fastener holes 128 that align with the fastener holes 124b located at the ends of the waveguide component 40. The end caps 52 and 54 are connected to the waveguide component 40 by installing fasteners 130 within these fastener holes.

Figure 15:
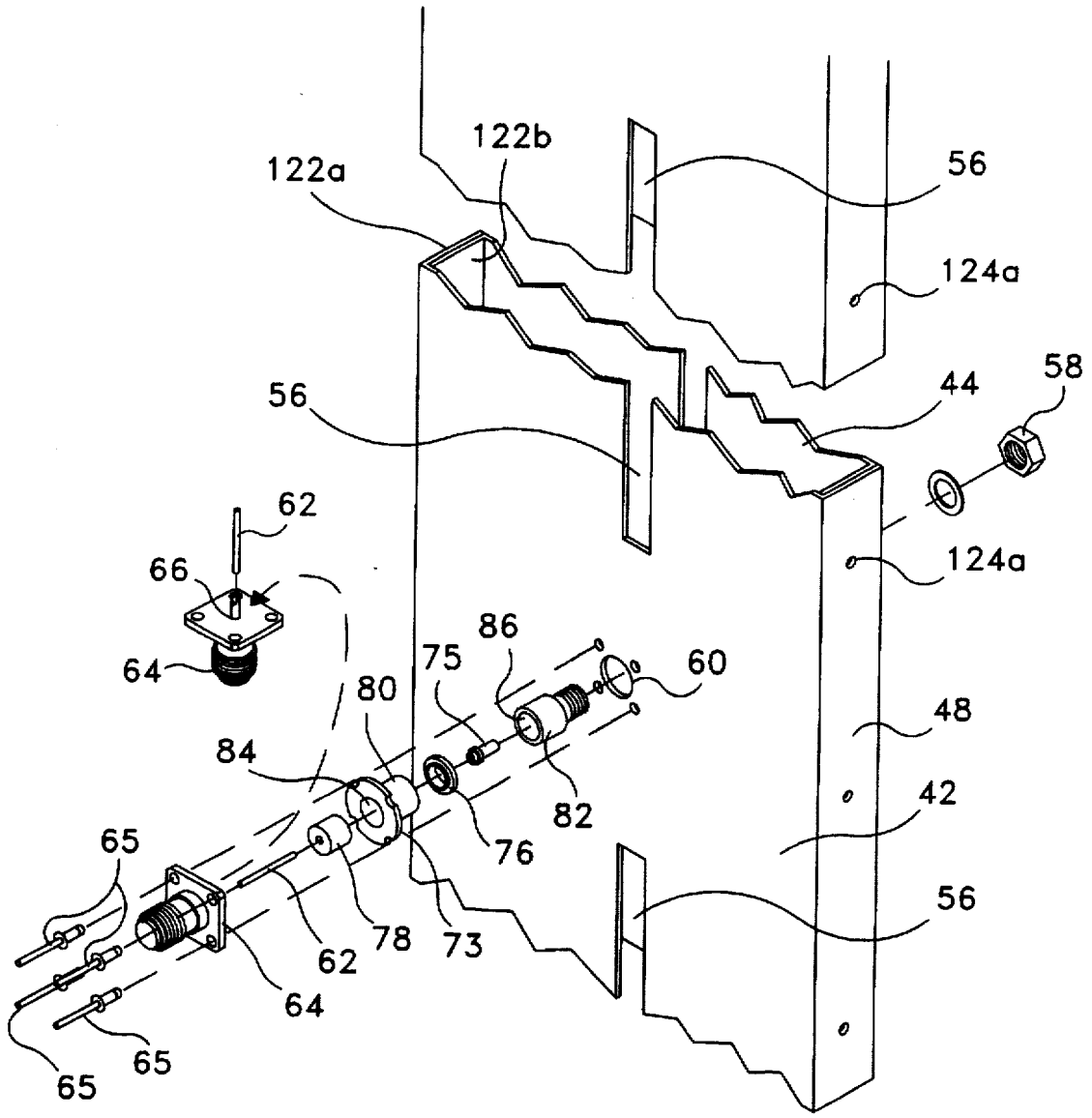
FIG. 15 is an illustration showing certain aspects of the assembly of a probe assembly for the preferred embodiment of the present invention.

FIG. 15 is an illustration showing the preferred components of the probe assembly 46 and connection of the probe assembly 46 to the waveguide component 40. The probe assembly 46 is connected to the rear wall 42 by installing fasteners 65 within the probe assembly holes 134. In addition, the nut 58 is threaded onto the extension of the probe assembly 46 to connect this portion of the probe to the front wall 44.

Those skilled in the art will recognize that the use of sheet metal fabrication techniques such as punching and folding may be substantially more cost-effective than prior art planar slot array antenna manufacturing approaches, such as the use of extruded waveguide components and machining of radiating slots.

The present invention provides the advantages of a low profile antenna having significant gain and the ability to withstand wind, rain and other environmental stresses. The antenna is relatively easy to install and offers the economical advantages of minimum material costs, minimum fabrication costs, and minimum assembly costs. Significantly, the present invention is a slotted array antenna having a reduced height waveguide implementation and a single feedpoint that replaces the waveguide or microstrip feed structures utilized in prior antennas, and provides a manufacturing approach that can rely upon simple, cost-effective sheet metal manufacturing processes.

While the present invention is susceptible to various modifications and alternative forms, a preferred embodiment has been depicted by way of example in the drawings and will be further described in detail. It should be understood, however, that it is not intended to limit the scope of the present invention to the particular embodiments described. On the contrary, the intention is to cover all modifications, equivalents, and alternatives falling within the spirit and scope of the invention as defined by the appended claims.

We claim:

1. An antenna, comprising:

an antenna assembly having a waveguide cavity formed by a plurality of intersecting wall segments, including a rear wall, a front wall, a pair of spaced-apart side walls, the rear wall and the front wall positioned in spaced-apart parallel planes and connected by the side walls, and end caps connected to each end of the waveguide cavity, at least one of the front and rear walls having a planar array of slots; and a probe, mounted to the approximate midpoint of the antenna assembly, for distributing radio frequency (RF) energy, the probe comprising:

a post, inserted perpendicular to the rear wall and to the front wall, connected to at least one of the rear wall and the front wall, including (1) a post cavity located within and extending along at least a portion of the post, and (2) a post slot having an opening located along the post and traversing the post cavity, and a probe pin, inserted within an end of the post cavity and connected to an opposite end of the post cavity, for coupling RF energy to the waveguide cavity via the post slot.

2. The antenna of claim 1 further comprising a dielectric spacing element for adjusting an impedance presented by the probe to the waveguide cavity, the dielectric spacing element, positioned within the opening of the post slot and adjacent to the probe pin, comprising a dielectric material and having a clearance hole for allowing passage of the probe pin through the dielectric spacing element.

3. The antenna of claim 1, wherein the electrical characteristics of the probe can be modeled by distributed impedance elements, including a series impedance defined by an inductive section comprising a combination of the post cavity and the probe pin within the post cavity, and a shunt impedance defined by a capacitive section comprising the dielectric spacing element within the post slot.

4. The antenna of claim 1 further comprising a dielectric tuning element for adjusting an impedance presented by the probe to the waveguide cavity, the dielectric tuning element, located within the opening of the post cavity and adjacent to a selected one of the front wall and the rear wall, comprising a dielectric material and having a clearance hole for allowing passage of the probe pin through the dielectric tuning element.

5. The antenna of claim 1 further comprising an antenna connector, mounted to a selected one of the rear wall and the front wall, comprising a center conductor for transporting the RF energy to and from the probe, the center conductor extending into the post cavity via a mounting opening within a selected one of the rear wall and the front wall.

6. The antenna of claim 5, wherein the probe pin comprises a combination of conductive element and the center conductor of the antenna connector, the conductive element connected between the center conductor and the opposite end of the post cavity, which is positioned at the nonselected one of the rear wall and the front wall.

7. The antenna of claim 1, wherein the probe presents a desired impedance to the waveguide cavity, and distributes RF energy of substantially equal amplitude and phase to each section of the waveguide cavity.

8. The antenna of claim 1, wherein the post slot is located at an approximate mid-point of the post and is centrally positioned within the waveguide cavity and between the front wall and the rear wall.

9. The antenna of claim 1, wherein the post slot is located between one end of the post and adjacent to a selected one of the rear wall and the front wall.

10. The antenna of claim 1, wherein the post is connected to a selected one of the front wall and the rear wall, and the post slot is located opposite to the selected one of the front wall and rear wall and adjacent to the nonselected one of the front wall and the rear wall.

11. The antenna of claim 1 further comprising an electronic module connected to one of the rear wall and the front wall, the electronic module electrically coupled to the probe pin and including at least one of a receiver for receiving the RF energy and a transmitter for transmitting the RF energy.

12. For an antenna comprising an antenna assembly having a waveguide cavity formed by a plurality of intersecting wall segments, including a rear wall, a front wall, and a pair of spaced-apart side walls, the rear wall and the front wall positioned in spaced-apart parallel planes and connected by the side walls, at least one of the front and rear walls having a planar array of slots, and a probe, coupled to the antenna assembly, for distributing radio frequency (RF) energy to the waveguide cavity, the probe comprising:

a post, positioned at the approximate midpoint of the antenna assembly, inserted perpendicular to the rear wall and to the front wall and connected to at least one of the rear wall and the front wall, including (1) a post cavity located within and extending along at least a portion of the post, and (2) a post slot having an opening located along the post and traversing the post cavity;

a probe pin, inserted within an end of the post cavity and connected to an opposite end of the post cavity, for coupling RF energy to the waveguide cavity via the post slot;

a dielectric spacing element for adjusting an impedance presented by the probe to the waveguide cavity, the dielectric spacing element, positioned within the opening of the post slot and adjacent to the probe pin, comprising a dielectric material and having a first clearance hole for allowing passage of the probe pin through the dielectric spacing element; and a dielectric tuning element for further adjusting the impedance presented by the probe to the waveguide cavity, the dielectric tuning element, located within the opening of the post cavity and adjacent to a selected one of the front wall and the rear wall, comprising another dielectric material and having a second clearance hole for allowing passage of the probe pin through the dielectric tuning element.

13. The probe of claim 12, wherein the electrical characteristics of the probe can be modeled by distributed impedance elements, including a series impedance defined by an inductive section comprising a combination of the post cavity and the probe pin within the post cavity, a shunt impedance defined by first capacitive section comprising the dielectric tuning element, and another shunt impedance defined by a second capacitive section comprising the dielectric spacing element within the post slot.

14. The probe of claim 12 further comprising an antenna connector, mounted to a selected one of the rear wall and the front wall, comprising a center conductor for transporting the RF energy to and from the probe, the center conductor extending into the post cavity via a mounting opening within the selected one of the rear wall and the front wall.

15. The probe of claim 14, wherein the probe presents a desired impedance to the waveguide cavity, and distributes RF energy of substantially equal amplitude and phase to each section of the waveguide cavity, and the probe pin comprises a combination of a conductive element and the center conductor of the antenna connector, the conductive element connected between the center conductor and the nonselected one of the rear wall and the front wall.

16. The probe of claim 12, wherein the post slot is located at an approximate mid-point of the post and is centrally positioned within the waveguide cavity and between the front wall and the rear wall.

17. The probe of claim 12, wherein the post is connected to the selected one of the front wall and the rear wall, and the post slot is located opposite to the selected one of the front wall and rear wall and adjacent to the nonselected one of the front wall and the rear wall.

18. For an antenna comprising an antenna assembly having a waveguide cavity formed by a plurality of intersecting wall segments, including a rear wall, a front wall, and a pair of spaced-apart side walls, the rear wall and the front wall positioned in spaced-apart parallel planes and connected by the side walls, and end caps connected to each end of the waveguide cavity, at least one of the front and rear walls having a planar array of longitudinal slots, and a probe, coupled to the antenna assembly, for distributing radio frequency (RF) energy to the waveguide cavity, the probe comprising:

a first shell, connected to the rear wall and extending into the waveguide cavity, having a first shell cavity located within and extending along at least a portion of the first shell;

a second shell, connected to the front wall and extending into the waveguide cavity, having a second shell cavity located within and extending along at least a portion of the second shell wherein the second shell is aligned in position with the first shell.

a probe pin, inserted within the first shell cavity and the second shell cavity for coupling RF energy to the waveguide cavity;

a dielectric spacing element for adjusting an impedance presented by the probe to the waveguide cavity, the dielectric spacing element, positioned between the first and second shells and adjacent to the probe pin, comprising dielectric material and having a first clearance hole for allowing passage of the probe pin through the dielectric spacing element;

a dielectric tuning element for further adjusting the impedance presented by the probe to the waveguide cavity, the dielectric tuning element, located within the first shell cavity and adjacent to the rear wall, comprising dielectric material and having a second clearance hole for allowing passage of the probe pin through the dielectric tuning element; and an antenna connector, mounted to the rear wall, comprising a center conductor for transporting the RF energy to and from the probe, the center conductor extending into the first shell cavity via a mounting opening within the rear wall and connected to the probe pin.

19. The probe of claim 18, wherein the probe is positioned at the approximate center point of the antenna assembly, presents a desired impedance to the waveguide cavity, and distributes RF energy of substantially equal amplitude and phase to each section of the waveguide cavity, and the probe pin comprises a combination of a conductive element and the center conductor of the antenna connector, the conductive element connected between the center conductor and the front wall.

20. A method for manufacturing an antenna comprising an antenna assembly comprising a waveguide cavity formed by a plurality of intersecting wall segments, including a rear wall, a front wall, and a pair of spaced-apart side walls, the rear wall and the front wall positioned in spaced-apart parallel planes and connected by the side walls, and end caps connected to each end of the waveguide cavity, at least one of the front and rear walls having a planar array of slots, and a probe assembly, coupled to the antenna body, for distributing radio frequency (RF) energy to the waveguide cavity, comprising the steps of:

(1) stamping first and second plates from sheet metal, the first plate having a minor dimension that is slightly greater than a corresponding minor dimension of the second plate;

(2) obtaining the end caps by extruding a selected metal stock;

(3) punching the slots and probe assembly holes into a selected one of the rear and the front wall, the slots positioned at predetermined intervals along the selected wall to achieve a desired radiation pattern, and mounting holes for the probe assembly placed at an approximate center point of the selected wall;

(4) punching the slots into the nonselected one of the front wall and the rear wall, the slots positioned at predetermined intervals along the nonselected wall to achieve the desired radiation pattern;

(5) punching a first set of fastener holes along the major dimension of the periphery of the front wall and the rear wall;

(6) punching a second set of fastener holes along the minor dimension of the periphery of the front wall and the rear wall;

(7) punching a third set of fastener holes along the periphery of the end caps, the third set of fastener holes aligned with the second set of fastener holes to support the connection of the end caps to each end of the antenna assembly;

(8) folding the first plate to form a first U-shaped section and folding the second plate to form a second U-shaped section, the first U-shaped section having the front wall and a pair of first wings extending from either side of the front wall, a minor dimension of the front wall being greater than a corresponding minor dimension of each first wing, the second U-shaped section having the rear wall and a pair of second wings extending from either side of the rear wall, a minor dimension of the rear wall being greater than a corresponding minor dimension of each second wing, the first U-shaped section having a minor dimension that is slightly greater than a corresponding minor dimension of the second U-shaped section to allow the second U-shaped section to be placed within the first U-shaped section;

(9) forming the waveguide cavity by placing the second U-shaped section within the first U-shaped section;

(10) connecting the first U-shaped section to the second U-shaped section by installing fasteners within the first set of fastener holes along the first and second wings, each first wing located adjacent to its corresponding second wing to form the side walls;

(11) connecting the end caps to the antenna assembly by installing fasteners within the second and third sets of fastener holes; and

(12) connecting the probe assembly to the selected wall by installing fasteners within selected ones of the probe assembly holes.

21. The manufacturing method of claim 20 further comprising the step of applying strips of weather resistant film to the front and rear walls to cover the slots, thereby protecting the interior of the antenna assembly from exposure to the environment.

* * * * *